US010611969B2

(12) United States Patent
Perez-Cordova

(10) Patent No.: US 10,611,969 B2
(45) Date of Patent: Apr. 7, 2020

(54) FLASH CHEMICAL IONIZING PYROLYSIS OF HYDROCARBONS

(71) Applicant: Racional Energy & Environment Company, Conroe, TX (US)

(72) Inventor: Ramon Perez-Cordova, Conroe, TX (US)

(73) Assignee: Racional Energy & Environment Company, Conroe, TX (US)

( * ) Notice: Subject to any disclaimer, the term of this patent is extended or adjusted under 35 U.S.C. 154(b) by 0 days.

(21) Appl. No.: 16/663,838

(22) Filed: Oct. 25, 2019

(65) Prior Publication Data

US 2020/0056100 A1 Feb. 20, 2020

Related U.S. Application Data

(60) Continuation-in-part of application No. 16/433,021, filed on Jun. 6, 2019, which is a division of (Continued)

(51) Int. Cl.
*C10G 11/04* (2006.01)
*C10G 11/08* (2006.01)
(Continued)

(52) U.S. Cl.
CPC ..... *C10G 11/04* (2013.01); *C10G 11/02* (2013.01); *C10G 11/08* (2013.01); *C10G 11/16* (2013.01)

(58) Field of Classification Search
CPC ..... C10G 11/02; C10G 11/04; C10G 11/08; C10G 11/16
See application file for complete search history.

(56) References Cited

U.S. PATENT DOCUMENTS 2,088,214 A 7/1937 Pfirrmann
2,455,696 A 12/1948 Mosesman
(Continued)

FOREIGN PATENT DOCUMENTS

CA 2470695 12/2004
CN 101642703 7/2011
(Continued)

OTHER PUBLICATIONS

Yang, Ming-Gang and Eser, Semih, Upgrading a High Asphaltene Content Petroleum Residue by Hydrogenation with a NiMo-supported Catalyst, Fuel Scientc Program and the Energy Institute, pp. 471-475.
(Continued)

*Primary Examiner* — Brian A McCaig
(74) *Attorney, Agent, or Firm* — Daniel N. Lundeen; Lundeen & Lundeen PLLC

(57) ABSTRACT

Flash chemical ionizing pyrolysis (FCIP) at 450° C.-600° C. forms liquid ionizing pyrolyzate (LIP) that can be blended in oil feedstock for thermal processes to promote conversion of heavier hydrocarbons to reduce resid/coke yields and/or increase yields of liquid hydrocarbons and isomerates. A front-end refinery process modifies crude oil with LIP for distillation to reduce resid/coke yields and/or increase liquid oil yields. A downstream process modifies a heavy oil stream such as resid with LIP and the LIP-modified stream can be thermally processed to reduce resid/coke yields and/or increase liquid oil yields. FCIP of the LIP blends also improves quality and/or yields of the liquid pyrolyzate product. Finely divided FCIP solids can contain $FeCl_3$ supported on NaCl-treated calcium bentonite. A process for preparing the FCIP solids treats iron with HCl and $HNO_3$ to form acidified $FeCl_3$ of limited solubility, loads the $FeCl_3$ on
(Continued)

NaCl-treated bentonite, and heat-treats the material at 400° C.-425° C.

22 Claims, 9 Drawing Sheets

Related U.S. Application Data application No. 14/957,659, filed on Dec. 3, 2015, now Pat. No. 10,336,946.

(60) Provisional application No. 62/750,708, filed on Oct. 25, 2018, provisional application No. 62/087,148, filed on Dec. 3, 2014, provisional application No. 62/087,164, filed on Dec. 3, 2014.

(51) Int. Cl.
*C10G 11/02* (2006.01)
*C10G 11/16* (2006.01)

(56) References Cited

U.S. PATENT DOCUMENTS

| | | | | |
|---|---|---|---|---|
| 2,835,553 | A | 5/1958 | Rufford et al. | |
| 3,173,853 | A | 3/1965 | Peralta | |
| 3,213,037 | A | 10/1965 | Hodgkiss | |
| 3,544,650 | A | 12/1970 | Garwood | |
| 3,544,659 | A | 12/1970 | Schwab et al. | |
| 3,721,632 | A | 3/1973 | Miller et al. | |
| 3,926,847 | A | 12/1975 | Beard et al. | |
| 3,960,706 | A | 6/1976 | McCollum et al. | |
| 3,979,332 | A | 9/1976 | Kiovsky et al. | |
| 4,039,651 | A | 8/1977 | Knoche | |
| 4,405,445 | A | 9/1983 | Kovach et al. | |
| 4,545,974 | A | 10/1985 | Thompson | |
| 4,557,821 | A | 12/1985 | Lopez et al. | |
| 4,743,357 | A | 5/1988 | Patel et al. | |
| 4,804,803 | A | 2/1989 | Schmidt et al. | |
| 5,688,395 | A | 11/1997 | Carrazza et al. | |
| 5,885,441 | A | 3/1999 | Pereira et al. | |
| 6,774,149 | B1 | 8/2004 | Gagnon | |
| 7,585,406 | B2 | 9/2009 | Khadzhiev et al. | |
| 8,006,758 | B2 | 8/2011 | Reynolds et al. | |
| 8,372,441 | B2 | 2/2013 | Thompson et al. | |
| 8,455,405 | B2 | 6/2013 | Chakrabarty | |
| 8,481,602 | B2 | 7/2013 | Gagnon | |
| 8,663,607 | B2 | 3/2014 | Monzyk et al. | |
| 10,336,946 | B2 | 7/2019 | Perez-Cordova | |
| 2007/0113736 | A1 | 5/2007 | Bandosz | |
| 2010/0147743 | A1* | 6/2010 | MacArthur | C10G 1/002 208/57 |
| 2011/0059009 | A1 | 3/2011 | Amendola | |
| 2014/0315764 | A1 | 10/2014 | Perez-Cordova | |
| 2014/0360917 | A1 | 12/2014 | Park et al. | |
| 2016/0039669 | A1 | 2/2016 | Brunet | |
| 2016/0160131 | A1* | 6/2016 | Perez-Cordova | C10G 11/08 208/120.1 |

FOREIGN PATENT DOCUMENTS

| | | |
|---|---|---|
| CN | 101786685 A | 11/2011 |
| EP | 1496016 | 1/2005 |
| EP | 1386881 | 7/2016 |
| GB | 902338 | 8/1962 |
| GB | 2313131 | 11/1997 |
| JP | 2015164909 | 9/2015 |
| WO | 2013066089 | 5/2013 |

OTHER PUBLICATIONS

Powers, Edward Joseph, Thermochemical Water Splitting Cycles: Oxygen Liberation Reactions, M.S. Thesis Submitted to Iowas State University 1975.

Haseli, Yousef, Analysis of Hydrodynamic Transport Phenomena in a Fluidized Bed for Thermochemical Hydrogen Production. Thesis Submitted to University of Ontario Institute of Technology, Apr. 2008.

Mavroyannis, C. and Winkler, C.A., The Reaction of Nitrogen Atoms With Hydrogen Atoms, Canadian Journal of Chemistry, vol. 40, 1062, pp. 240-245.

Nanda, Arun K., The Kinetics of the Reverse Deacon Reaction, Iowa State University, 1981.

Kawamura, Fumio and Taniguchi, Takashi, Synthesis of Ammonia Using Sodium Melt, Scientific Reports, 7: 11578, Sep. 14, 2017, pp. 1-4.

Wada, Shin-Ichiro and Weerasooriya, Janaki Deepa, Sodium-calcium, calcium-potassium, and potassium-sodium exchange equilibria on a montmorillonitic soil, Soil Science and Plant Nutrition, 2012, 36:3, 451-459.

Ganiev, I.M., et al., Reactions of Chlorine Dioxide with Organic Compounds, Eurasian ChemTech Journal, 7 (2005) 1-31.

Knoche, K.F. et al., A Thermochemical Process for Hydrogen Production, International Journal of Hydrogen Energy, vol. 1, pp. 23-32, Pergamon Press, 1976.

Subrt, J. and Tobola, K., DTA Study of the Kinetics of Sodium Hydride Decomposition, Journal of Thermal Analysis, vol. 10 (1976) pp. 5-12.

Chuzlov, Viacheslav A. et al., Simulation of Light Naphtha Isomerization Process, Procedia Chemistry 15 (2015) pp. 282-287.

Computed Potential Energy Surfaces for Chemical Reactions, National Aeronautics and Space Administration Ames Research Center Moffett Field, 1990, pp. 1-20.

Okamoto, H., H-Na (Hydrogen-Sodium), Journal of Phase Equilibria and Diffusion, vol. 31, No. 5, 2010, p. 494.

Campano, Barlow R., The Kleingarn Regenerated Spent Acid at Increasing Ferrous (Fe+2) and Ferric Chloride (Fe+3) Content, Dec. 2012, pp. 1-18.

Bell, Osborne, Determination of elements in aqua regia and nitric acid digests by flame atomic absorption spectrometry, https://kipdf.com/determination-of-elements-in-aqua-regia-and-nitric-acid-digests-by-flame-atomic-_5b2dd949097c4708778b49a9.html, 2004, pp. 1-17.

Hardwick, T.J., The Rate Constant of the Reaction Between Ferrous Ions and Hydrogen Peroxide in Acid Solution, Canadian Journal of Chemistry, vol. 35, 1957, pp. 428-436.

* cited by examiner

FLASH CHEMICAL IONIZING PYROLYSIS OF HYDROCARBONS

CROSS REFERENCE TO RELATED APPLICATIONS

This application is a non-provisional of and claims the benefit of and priority to U.S. Ser. No. 62/750,708, filed Oct. 25, 2018. This application is a continuation-in-part of U.S. Ser. No. 16/433,021, filed Jun. 6, 2019, which is a divisional of U.S. Ser. No. 14/957,659, filed Dec. 3, 2015, now U.S. Pat. No. 10,336,946 B2, which claims priority benefit to my earlier U.S. provisional application Nos. 62/087,148, filed Dec. 3, 2014, and 62/087,164, filed Dec. 3, 2014. All priority documents are herein incorporated by reference in their entireties.

BACKGROUND

The crude oil refining industry is ever in need of more efficient and/or improved refining techniques to obtain products from petroleum. Many crudes, including heavy crude oil and many crudes with a high "resid" yield from distillation, are difficult to refine and have poor conversion of the heavier hydrocarbon fractions, especially asphaltenes, to valuable products. In a typical refinery process, the crude must be washed with water to remove salts and dehydrated in advance of atmospheric and vacuum distillation. Distillation recovers the lighter, valuable fractions of the oil, e.g., butane and lighter products, gasoline blending components, naphtha, kerosene, jet fuel, and distillates, e.g., diesel and heating oil. The heavier components such as medium and heavy weight gas oil may be processed in cracking and/or alkylation units to obtain LPG, gasoline, jet fuel, diesel fuel, etc., whereas the resid, representing the heaviest components such as resins and asphaltene, may be processed in a coker to obtain coke and coker gas oil and/or used as asphalt base. Some of the heavier components may conventionally contain a small amount of lube oil base stock, which are relatively low viscosity high-carbon oils, however, the conventional yields of base stocks from petroleum are quite low, typically 0.5-1 volume percent of the crude oil. Processing excessive amounts of resid such as in a delayed coker is undesirable and often not economical.

The blending optimization of crude oils has been used in refinery operations to increase the refined margins and commercial value. For example, Li et al., "Distillation Yields and Properties from Blending Crude Oils: Maxila and Cabinda Crude Oils, Maxila and Daqing Crude Oils," *Energy &Fuels* (2007) 21(2), 1145-1150 (DOI: 10.1021/ef060316d), discloses the optimized blending ratio was 3:7 for Maxila and Cabinda or Daqin crude oils, and the distillation yields (<520° C.) were higher than theoretical. Demirbas et al., "Optimization of crude oil refining products to valuable fuel blends," *Petroleum Science and Technology,* 35:4, 406-412, (2017) DOI: 10.1080/10916466. 2016. 1261162, discloses simulation software, such as linear programming modeling, to estimate and optimize the blending of crude oils, especially cheaper crude oils.

Conversion of heavy crude fractions to lighter ones often requires expensive catalysts that need recovery, regeneration, and recycle to be economic. Moreover, expensive catalysts may require pretreatment of the feedstock to ensure catalyst poisons like sulfur are removed. Conversion is generally a downstream process, often applied to the least possible quantity of material after the more valuable, easily recoverable hydrocarbon fractions have been recovered. Conversion processes often need to operate at high pressure, with the addition of external hydrogen, and/or with long residence times, to maximize conversion and minimize capital costs.

Frequently, the "upgraded" products are of poor quality and may still require blending with more valuable petroleum fractions, and even then, the blended products are often only suitable for use as fuel oil. In some instances, the heavier fractions and resid have been simply disposed of, and many places in the world are overrun with stores of such material that are difficult to economically process. The main product obtained from the resid is coke, which often has low value and entails difficult processing and handling operations. Hence, refineries have a strong incentive to minimize resid yields and coke production.

My earlier patent, U.S. Pat. No. 10,336,946 B2, discloses a process for upgrading heavy oil comprising feeding to a reactor an emulsion of 100 parts by weight heavy oil, 5-100 parts by weight water, and 1-20 parts by weight solid particulates comprising a mineral support and an oxide or acid addition salt of a Group 3-16 metal, e.g., $FeCl_3$ on NaCl-treated clay, and spraying the feed mixture in the reactor at a high temperature and low pressure. Further improvements in liquid oil yield and quality, especially in the conversion of asphaltenes to saturates, especially isomerates, and aromatics as reflected in a SARA analysis, are desired.

As reported in Amani et al., *J Pet Environ Biotechnol* 2017, 8:3 DOI: 10.4172/2157-7463.1000330, in the refining of crude oil, great pains are taken in pretreating the crude to remove entrained water and salt before distillation. Sometimes the water and oil are in the form of an emulsion or rag that can be exceedingly difficult to break. Large sums are spent to dewater and desalt crude oil. Additionally, the crude oil is typically pre-heated prior to distillation, but this must be done very slowly and carefully to avoid forming coke or other deposits on the heat transfer surfaces that can result in fouling, especially in the case of heavy and/or highly viscous crudes. The industry is ever in search of ways to avoid or reduce the problems and costs incident to pretreating and preheating crude oil.

Sulfur is an undesirable crude oil contaminant. Sour crude contains more than 0.5 wt % sulfur. Crude oil stabilization can remove some $H_2S$ before refining, but organic sulfides generally build up during refining and are removed downstream with the higher-boiling constituents. There is a need in the art for better ways to remove sulfides from crude oil. An upstream pretreatment method would be especially advantageous, so that sulfur could be removed to provide a lower level of sulfur in the higher-boiling, downstream refining products.

It is known from Hancsók, Jenő et al., Importance of Isoparaffins in the Crude Oil Refining Industry, *Chemical Engineering Transactions,* 11, 41-47 (2007), that isomerates such as isoparaffins have the most advantageous performance properties in gasoline, diesel fuel, and base oils. However, isomerates are usually made in exacting downstream processes such as benzene saturating isomerization, catalytic hydrodewaxing of gas oils, selective isomerization of lubricating base oils, and so on. The industry would benefit from an inexpensive way to distill or otherwise process crude oil in such a manner to increase isomerate yields.

There remains a need for more efficient techniques and systems to refine and process petroleum and other hydrocarbons with ever higher yields of lighter, higher-value hydrocarbon products, while reducing the amount of resid and coke that must be handled. A solution would preferably be an upstream process to treat crude oil; minimize asphaltene and coke yields; improve saturates and/or aromatics yields; improve the quality of the saturates with increased isomerates production; improve lube oil base stock yields; minimize end product blending requirements; employ mild pressure conditions with a short residence time and high throughput using inexpensive chemical additives; reduce the need for feedstock pretreatment or conditioning to remove catalyst poisons; reduce the need for dewatering and/or desalting; facilitate crude preheating by minimizing fouling in the pre-heaters; and/or avoid adding hydrogen.

SUMMARY

The present invention discloses a process applicant refers to herein as "flash chemical ionizing pyrolysis" or FCIP, and a liquid ionizing pyrolyzate or LIP produced by the process. FCIP can be used as a method to pretreat crude oil, optionally without dewatering, to convert asphaltenes from the crude, and form a resulting LIP with a reduced sulfide content, increased isomerates content, and other improvements detailed hereinbelow.

It has been quite unexpectedly found that, when the LIP is blended in a relatively small proportion with another oil stock comprising asphaltenes and the LIP blend is thermally processed, e.g., by distillation in an otherwise conventional manner, the amount of valuable liquid oil products that is recovered from the blends is substantially increased, whereas the resid from the oil stock is rather substantially reduced. Moreover, the resid has a surprisingly low Conradson carbon residue, and a viscosity—it is readily pourable at 50° C.—suggesting a high lube oil content. The LIP can be used as a blend component either in a "front-end" process for crude oil prior to or in conjunction with distillation, or in a downstream process to upgrade a stream comprising heavy gas oil, resins, asphaltenes, resid, etc. When the LIP-modified feedstock is thermally processed, such as in atmospheric or vacuum distillation, or in FCIP, there is an unexpectedly low resid yield and/or a high liquid oil yield, e.g., in excess of theoretical. Thus, LIP-modified crude can dramatically reduce the amount of resid and coke that is produced in a refinery to a greater extent than could be attributed to the presence of the LIP as an ordinary low-resid blending component.

Moreover, introducing the LIP into the feed to a pyrolysis process such as FCIP also synergistically improves the quality and/or yield of the pyrolyzate, e.g., the LIP from FCIP of an LIP-modified crude results in a synergistically lower sulfur content. The present invention also discloses a pyrolysis process and additive that has improved performance relative to the disclosure in my earlier U.S. Pat. No. 10,336,946 B2.

Although not wishing to be bound by theory, these synergistic, transformative properties of the liquid ionizing pyrolyzate are believed to contain ionized species, such as relatively stable free radicals and hydrogen-rich donor compounds, that may inhibit aggregation of maltenes and asphaltenes in petroleum fractions and/or promote the formation of isomerates and/or alkylates in a manner consistent with hydrocracking, but at a lower range of temperatures and near atmospheric pressures. This is evidenced by an unexpected reduction of viscosity when the LIP is added to crude oil, and also by improved liquid oil yields from distillation and/or pyrolysis of an LIP-crude oil blend.

In one aspect, embodiments according to the present invention provide a hydrocarbon conversion process comprising: emulsifying water and an oil component with finely divided solids comprising a mineral support and an oxide and/or acid addition salt of a Group 3-16 metal (preferably $FeCl_3$ on an NaCl-treated clay); introducing the emulsion into a flash chemical ionizing pyrolysis (FCIP) reactor maintained at a temperature greater than about 400° C. up to about 600° C. and an absolute pressure up to about 1.5 atm to form a chemical ionizing pyrolyzate effluent; condensing a liquid ionizing pyrolyzate (LIP) from the effluent; combining a feedstock oil with the LIP to form a pyrolyzate-feedstock blend; and thermally processing the blend at a temperature above about 100° C.

In another aspect, embodiments according to the present invention provide a flash chemical ionizing pyrolysis (FCIP) process comprising the steps of: preparing a feed emulsion comprising 100 parts by weight of an oil component, from about 1 to 100 parts by weight of water, and from about 1 to 20 parts by weight of finely divided solids comprising a mineral support and an oxide or acid addition salt of a Group 3-16 metal (preferably $FeCl_3$ on an NaCl-treated clay); spraying the feed emulsion in a flash pyrolysis reactor at a temperature from about 425° C. to about 600° C.; collecting an effluent from the reactor; recovering a liquid ionizing pyrolyzate (LIP) from the effluent; and supplying a portion of the LIP as a portion of the oil component in the feed emulsion preparation step.

In a further aspect, embodiments according to the present invention provide a hydrocarbon refinery process comprising the steps of: combining a liquid ionizing pyrolyzate (LIP) blend component with a feedstock oil at a weight ratio from about 1:100 to about 1:1 to form an LIP blend; preparing an emulsion comprising (i) a first portion of the LIP blend, (ii) water, and (iii) finely divided solids comprising a mineral support and an oxide or acid addition salt of a Group 3-16 metal (preferably $FeCl_3$ on an NaCl-treated clay); spraying the emulsion in a flash pyrolysis reactor at a temperature from about 425° C. to about 600° C. and a pressure from about 1 to about 1.5 atm; collecting an effluent from the reactor; recovering a product LIP from the effluent; incorporating the product LIP as the LIP blend component in the LIP blend; and distilling a second portion of the LIP blend.

In a further aspect still, embodiments of the present invention provide a hydrocarbon refinery process comprising the steps of: preparing a feed emulsion comprising (i) 100 parts by weight of an oil component, (ii) from about 1 to 100 parts by weight of water, and (iii) from about 1 to 20 parts by weight finely divided solids comprising a mineral support and an oxide or acid addition salt of a Group 3-16 metal (preferably $FeCl_3$ on an NaCl-treated clay); spraying the feed emulsion in a flash pyrolysis reactor at a temperature from about 425° C. to about 600° C.; collecting an effluent from the flash pyrolysis reactor; recovering a liquid ionizing pyrolyzate (LIP) from the effluent; combining the recovered LIP with a feedstock oil comprising crude oil or a petroleum fraction selected from gas oil, resid, or a combination thereof to form a pyrolyzate-feedstock blend; distilling, cracking, visbreaking, and/or coking a first portion of the blend; and supplying a second portion of the blend as the oil component in the feed emulsion preparation step.

In yet another aspect, embodiments according to the present invention provide a crude oil upgrading process comprising blending a liquid ionizing pyrolyzate (LIP) with a heavy oil, and thermally processing the blend at a temperature above about 100° C.

DETAILED DESCRIPTION

Figure 1:
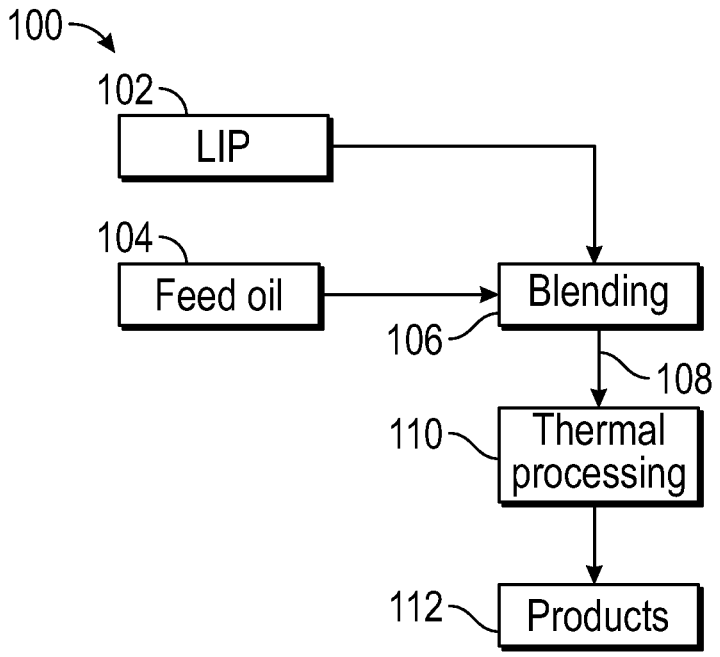
FIG. 1 shows a schematic flow diagram of thermally processing a blend comprising a liquid ionizing pyrolyzate (LIP) from flash chemical ionizing pyrolysis (FCIP), according to embodiments of the present invention.

The words and phrases used herein should be understood and interpreted to have a meaning consistent with the understanding of those words and phrases by those skilled in the relevant art. No special definition of a term or phrase is intended except where such a special definition is expressly set forth in the specification. The following definitions are believed to be consistent with their understanding by the skilled person, and are provided for the purpose of clarification.

As used in the specification and claims, "near" is inclusive of "at." The term "and/or" refers to both the inclusive "and" case and the exclusive "or" case, whereas the term "and or" refers to the inclusive "and" case only and such terms are used herein for brevity. For example, a component comprising "A and/or B" may comprise A alone, B alone, or both A and B; and a component comprising "A and or B" may comprise A alone, or both A and B.

For purposes herein the term "alkylation" means the transfer of an alkyl group from one molecule to another, inclusive of transfer as an alkyl carbocation, a free radical, a carbanion or a carbene, or their equivalents.

For purposes herein, API refers to the American Petroleum Institute gravity (API gravity), which is a measure of the density of a petroleum product at 15.6° C. (60° F.) compared to water at 4° C., and is determined according to ASTM D1298 or ASTM D4052, unless otherwise specified. The relationship between API gravity and s.g. (specific gravity) is API gravity=(141.5/s.g.)−131.5.

As used herein, the term "aqua regia" refers to any concentrated mixture of hydrochloric and nitric acids.

As used herein, "asphaltenes" refer to compounds which are primarily composed of carbon, hydrogen, nitrogen, oxygen, and sulfur, but which may include trace amounts of vanadium, nickel, and other metals. Asphaltenes typically have a C:H ratio of approximately 1:1.1 to about 1:1.5, depending on the source. Asphaltenes are defined operationally as the n-heptane ($C_7H_{16}$)-insoluble, toluene ($C_6H_5CH_3$)-soluble component of a carbonaceous material such as crude oil, bitumen, or coal. Asphaltenes typically include a distribution of molecular masses in the range of about 400 g/mol to about 50,000 g/mol, inclusive of aggregates.

For purposes herein the term "atmospheric distillation" means distillation where an uppermost stage is in fluid communication with the atmosphere or with a fluid near atmospheric pressure, e.g., less than 5 psig.

For purposes herein, the abbreviation AET refers to "atmospheric equivalent temperature" of distillation, which is the temperature calculated from an observed vapor temperature at a pressure below atmospheric according to the Maxwell and Bonnell equations as described in Annex A9 to ASTM D2892-18a.

For purposes herein the term "blending" means combining two or more ingredients regardless of whether any mixing is used.

For purposes herein the term "calcination" refers to heating a material in air or oxygen at high temperatures, e.g., at or above about 400° C.

For purposes herein the term "catalyst" means a substance that increases the rate of a chemical reaction usually but not always without itself undergoing any chemical change. For example, noble metal catalysts can become slowly poisoned as they contact deleterious substances.

As used herein, "clay" refers to a fine-grained material comprising one or more clay minerals, i.e., a mineral from the kaolin group, smectite group (including montmorillonite), illite group, or chlorite group, or other clay types having a 2:1 ratio of tetrahedral silicate sheets to octahedral hydroxide sheets.

For purposes herein the term "coking" refers to the thermal cracking of resid in an oil refinery processing unit known as a "coker" that converts a heavy oil such as the residual oil from a vacuum distillation column into low molecular weight hydrocarbon gases, naphtha, light and heavy gas oils, and petroleum coke. Coking is typically effected at a temperature of about 480° C.

For purposes herein the term "cracking" means the process whereby complex organic molecules are broken down into simpler molecules by the breaking of carbon-carbon bonds in the precursors. "Thermal cracking" refers to the cracking of hydrocarbons by the application of temperature, typically but not always 500-700° C. and sometimes also pressure, primarily by a free radical process, and is characterized by the production of light hydrocarbon gases, $C_4$-$C_{15}$ olefins in moderate abundance, little aromatization, little or no branched chain alkanes, slow double bond isomerization, little or no skeletal isomerization, β-scission of alkylaromatics, and/or slow cracking of naphthenes. "Catalytic cracking" refers to the cracking of hydrocarbons in the presence of a catalyst, typically but not always at 475-530° C. that forms ionic species on catalyst surfaces, and is characterized by the production of little or no methane and/or ethane, little or no olefins larger than $C_4$, some aromatization of aliphatic hydrocarbons, rapid skeletal isomerization and branched chain alkanes, rapid olefin isomerization, α-scission or dealkylation of alkylaromatics, and/or cracking of naphthenes and n-paraffins at comparable rates. "Hydrocracking" refers to cracking in the presence of hydrogen, typically but not always at 260-425° C. and using a bifunctional catalyst comprising an acid support such as silica, alumina, and/or zeolite, and a metal, resulting in hydrogenation or saturation of aromatic rings and decyclization.

For purposes herein the term "crude oil" means an unrefined liquid mixture of hydrocarbons that is extracted from certain rock strata.

For purposes herein the term "desalting" means the removal of salt from petroleum in a refinery unit referred to as a "desalter" in which the crude oil is contacted with water and separated to remove the salt in a brine.

For purposes herein the term "distillation" means the process of separating components or substances from a liquid mixture by selective boiling and condensation.

For purposes herein, "distillation temperature" refers to the distillation at atmospheric pressure or the AET in the case of vacuum distillation, unless otherwise indicated.

For purposes herein the term "emulsion" means a mixture of immiscible liquids in a discontinuous dispersed phase and a continuous phase, optionally including dispersed solids.

For purposes herein the term "flash pyrolysis" means thermal reaction of a material at a very high heating rate (e.g., ≥450° C./s, preferably ≥500° C.) with very short residence time (e.g., ≤4 s, preferably ≤2 s).

For purposes herein the term "flash chemical ionizing pyrolysis" or "FCIP" means flash pyrolysis of a material in the presence of a chemical additive to promote ionization and/or free radical formation and is sometimes referred to as "catalytic pyrolysis" as described in U.S. Pat. No. 10,336,946 B2.

For purposes herein "finely divided" refers to particles having a major dimension of less than 1 mm, and a minor dimension of less than 1 mm. A particulate "fine" is defined as a solid material having a size and a mass which allows the material to become entrained in a vapor phase of a thermodesorption process as disclosed herein, e.g., less than 250 microns.

For purposes herein the term "hydrocarbon" means a compound of hydrogen and carbon, such as any of those that are the chief components of petroleum and natural gas. For purposes herein the term "naphtha" refers to a petroleum distillate with an approximate boiling range from 40° C. to 195° C., a "kerosene" from greater than 195° C. to 235° C., a "distillate" from greater than 235° C. to 370° C., a "gas oil" from greater than 370° C. to 562° C.

For purposes herein the term "hydrocarbon conversion" means the act or process of chemically changing a hydrocarbon compound from one form to another.

For purposes herein, "incipient wetness loading" refers to loading a material on a support by mixing a solution and/or slurry of the material with a dry support such that the liquid from the solution and/or slurry enters the pores of the support to carry the material into the pores with the slurry, and then the carrier liquid is subsequently evaporated. Although not technically "incipient", in the present disclosure and claims "incipient wetness loading" specifically includes the use of a volume of the solvent or slurry liquid that is in excess of the pore volume of the support material, where the liquid is subsequently evaporated from the support material, e.g., by drying.

For purposes herein, "limited solubility" means that a material mostly does not dissolve in water, i.e., not more than 50 wt % of a 5 g sample is digested in 150 ml distilled water at 95° C. in 12 h; and "acid soluble" means that a material mostly dissolves in aqueous HCl, i.e., at least 50 wt % of a 5 g sample is digested in 150 ml of 20 wt % aqueous HCl at 95° C. in 12 h.

For purposes herein the term "liquid ionizing pyrolyzate" or "LIP" refers to an FCIP pyrolyzate that is liquid at room temperature and 1 atm, regardless of distillation temperature. In some embodiments, the LIP has blending characteristics indicative of the presence of ionized species and/or stable free radicals that can induce chemical and/or physical rearrangement of molecules or "normalization" in the blend components. For example, blending the LIP with crude containing asphaltenes results in viscosity changes that are more significant than would be predicted from conventional hydrocarbon blending nomographs, which is consistent with molecular rearrangement of the asphaltene molecules, including disaggregation. Such an unexpected viscosity reduction in turn produces unexpected increases in the efficiencies of thermal processes such as distillation, for example, employing the blend.

In some embodiments, the LIP has blending characteristics such that when blended with a specific blend oil, obtains a distillation liquid oil yield (<562° C.) that is greater than a theoretical liquid oil yield, and/or obtains a total resid yield (>562° C.) that is in an amount less than a theoretical resid yield, wherein the theoretical yields of the blend are calculated as a weighted average of the separate distillation of the LIP and blend oil alone, wherein yields are determined by atmospheric distillation in a 15-theoretical plate column at a reflux ratio of 5:1, according to ASTM D2892-18 up to cutpoint 400° C. AET, and by vacuum potstill method according to ASTM D5236-18a above the 400° C. cutpoint to cutpoint 562° C. AET. Preferably, the LIP has one, or preferably more, or more preferably all, of the following oil blending characteristics:

1) for a blend of Oil:LIP of 90:10, the liquid hydrocarbon yield, obtained from distillation of the blend up to a distillation temperature of 562° C., is equal to or greater than 1% (preferably at least 1.5%) more than the theoretical yield, wherein the percentage is absolute; and/or
2) for a blend of Oil:LIP of 90:10, a resid yield, obtained from the distillation of the blend that is decreased in an amount equal to or more than 1.5% (preferably at least 2.5%) of the theoretical resid yield, wherein the percentage is absolute; and/or
3) for a blend of Oil:LIP of 90:10, amounts of distillation of the blend into a first fraction <290° C., a second fraction 291-331° C., a third fraction 332-378° C., a fourth fraction 379-440° C., and a fifth fraction 441-531° C., are greater than theoretical amounts of the respective fractions, wherein the theoretical amounts of the blend fractions are calculated as weighted averages of the separate distillation of the LIP and blend oil alone; and/or
4) for a blend of Oil:LIP of 90:10, densities of fractions distilled into a first fraction <290° C., a second fraction 291-331° C., a third fraction 332-378° C., a fourth fraction 379-440° C., and a fifth fraction 441-531° C., are less than or equal to the densities in respective fractions obtained from distillation of the blend oil alone, preferably wherein the density in at least one of the distilled blend oil fractions is less than the density of the respective blend oil fraction(s); and/or 5) for a blend of Oil:LIP of 80:20, the liquid hydrocarbon yield, obtained from distillation of the blend up to a distillation temperature of 562° C., is equal to or greater than 1.5% (preferably at least 2.5%) more than the theoretical yield, wherein the percentage is absolute; and/or 6) for a blend of Oil:LIP of 80:20, a resid yield, obtained from the distillation of the blend that is decreased in an amount equal to or more than 2.5% (preferably at least 4%) of the theoretical resid yield, wherein the percentage is absolute; and/or 7) for a blend of Oil:LIP of 80:20, amounts of distillation of the blend into a first fraction <290° C., a second fraction 291-331° C., a third fraction 332-378° C., a fourth fraction 379-440° C., and a fifth fraction 441-531° C., are greater than theoretical amounts of the respective fractions, wherein the theoretical amounts of the blend fractions are calculated as weighted averages of the separate distillation of the LIP and blend oil alone; and/or 8) for a blend of Oil:LIP of 80:20, densities of fractions distilled into a first fraction <290° C., a second fraction 291-331° C., a third fraction 332-378° C., a fourth fraction 379-440° C., and a fifth fraction 441-531° C., are less than or equal to the densities in respective fractions obtained from distillation of the blend oil alone, preferably wherein the density in at least two, or more preferably in at least three, of the blend fractions is less than the density of the respective blend oil fraction(s).

9) for a blend of Oil:LIP of 70:30, the liquid hydrocarbon yield, obtained from distillation of the blend up to a distillation temperature of 562° C., is equal to or greater than 2% (preferably at least 3%) more than the theoretical yield, wherein the percentage is absolute; and/or 10) for a blend of Oil:LIP of 70:30, a resid yield, obtained from the distillation of the blend that is decreased in an amount equal to or more than 3% (preferably at least 5%) of the theoretical resid yield, wherein the percentage is absolute; and/or 11) for a blend of Oil:LIP of 70:30, amounts of distillation of the blend into a first fraction <290° C., a second fraction 291-331° C., a third fraction 332-378° C., a fourth fraction 379-440° C., and a fifth fraction 441-531° C., are greater than theoretical amounts of the respective fractions, wherein the theoretical amounts of the blend fractions are calculated as weighted averages of the separate distillation of the LIP and blend oil alone; and/or 12) for a blend of Oil:LIP of 70:30, densities of fractions distilled into a first fraction <290° C., a second fraction 291-331° C., a third fraction 332-378° C., a fourth fraction 379-440° C., and a fifth fraction 441-531° C., are less than or equal to the densities in respective fractions obtained from distillation of the blend oil alone, preferably wherein the density in at least two, or more preferably in at least three, of the blend fractions is less than the density of the respective blend oil fraction(s).

As used herein, unless indicated, a "liquid oil" or "liquid product" or "liquid hydrocarbon" refers to the fraction(s) of petroleum from distillation that are normally liquid at room temperature and 1 atm obtained at distillation temperatures from 29° C. to 562° C. AET, including gasoline blending components, naphtha, kerosene, jet fuel, distillates, diesel, heating oil, and gas oil; whereas a "resid" or "heavy product" or "heavy hydrocarbon" refers to the residual oil remaining after distillation to 562° C. AET, including resins, asphaltenes, and/or coke.

For purposes herein the term "oil" means any hydrophobic, lipophilic chemical substance that is a liquid at ambient temperatures.

All percentages are expressed as weight percent (wt %), based on the total weight of the particular stream or composition present, unless otherwise noted. All parts by weight are per 100 parts by weight oil, adjusted for water and/or solids in the oil sample (net oil), unless otherwise indicated. Parts of water by weight include water added as well as water present in the oil.

For purposes herein the term "pyrolysis" means decomposition brought about by high temperatures.

For purposes herein the term "ionizing pyrolyzate" means the oil condensed or otherwise recovered from the effluent of flash chemical ionizing pyrolysis.

Room temperature is 23° C. and atmospheric pressure is 101.325 kPa unless otherwise noted.

For purposes herein, SARA refers to the analysis of saturates, aromatics, resins, and asphaltenes in an oil sample. SARA can be determined by IP 143 followed by preparative HPLC (IP-368) or Clay-Gel (ASTM D-2007), or by IATROSCAN TLC-FID. For the purposes of the claims, in the event of a conflict, the results from ASTM D-2007 shall control.

For purposes herein, the term "spray" means to atomize or otherwise disperse in a mass or jet of droplets, particles, or small pieces.

For purposes herein, sulfur in crude oil and pyrolyzates is determined according to ASTM D-4294. A "high sulfur" oil is one containing more than 0.5 wt % sulfur as determined by ASTM D-4294.

For purposes herein the term "thermal processing" means processing at an elevated temperature, e.g., above 100° C.

For purposes herein, viscosity is determined at 40° C. and 100 $s^{-1}$, unless otherwise stated, or if the viscosity cannot be so determined at 40° C., the viscosity is measured at higher temperatures and extrapolated to 40° C. using a power law equation.

Broadly, according to some embodiments of the invention, a process comprises combining a feedstock oil with a liquid ionizing pyrolyzate (LIP) to form a pyrolyzate-feedstock blend. The blend, quite unexpectedly, has a lower apparent viscosity at 40° C. and/or at 100° C. and a shear rate of 100 $s^{-1}$ than predicted using API nomographs. The feedstock oil preferably comprises asphaltenes. The LIP is preferably prepared by flash chemical ionizing pyrolysis (FCIP) as described in various embodiments herein.

In some embodiments according to the invention, a process comprises combining a feedstock oil with a liquid ionizing pyrolyzate (LIP) to form a pyrolyzate-feedstock blend; and thermally processing the blend. In any embodiment, the process can recover a light oil-enriched hydrocarbon product, e.g., a hydrocarbon product having an enriched yield of liquid hydrocarbons boiling at a temperature below 562° C., relative to separate thermal processing of the LIP and feedstock oil, relative to separate thermal processing of the LIP and feedstock oil, as determined by atmospheric distillation in a 15-theoretical plate column at a reflux ratio of 5:1, according to ASTM D2892-18 up to cutpoint 400° C. AET, and by vacuum potstill method according to ASTM D5236-18a above the 400° C. cutpoint to cutpoint 562° C. AET.

The feedstock oil may preferably be crude oil, which may be desalted or preferably un-desalted, but can also be, for example, gas oil, resid (atmospheric and/or vacuum), and the like, including mixtures or combinations.

The LIP is present in a sufficient amount to enhance light oil enrichment. There is no upper limit on the amount of LIP that can be used, but excessive amounts may not be economical. The pyrolyzate-feedstock blend can comprise the LIP in a weight ratio of about 1:100 to 1:1, preferably from 1:100 to 1:2, more preferably from about 1:20 to 1:3, even more preferably from about 1:10 to 1:4. Preferably, the percentages of LIP and feedstock oil total 100, i.e., the blend consists essentially of or consists of the LIP and the feedstock oil.

The thermal processing is preferably distillation, e.g., atmospheric and/or vacuum distillation, and/or flash chemical ionizing pyrolysis (FCIP), which may optionally be used to produce the LIP, but the thermal processing can also be, for example, heating, cracking (thermal and/or catalytic), alkylation, visbreaking, coking, and so on, including combinations in parallel and/or series.

With reference to the embodiment of the invention shown in the simplified schematic flow diagram of FIG. 1, broadly, in process 100, a liquid ionizing pyrolyzate (LIP) 102 is combined with a feed oil 104 in blending step 106. LIP 102 from any source can be used, preferably from an FCIP process as described herein, e.g., LIP 424 from FIG. 4, LIP 502 from FIG. 5, and/or LIP 604 from FIG. 6. The feed oil 104 can be any suitable hydrocarbon liquid, such as, for example, crude oil (including heavy crude oil), which can be desalted or un-desalted, petroleum distillation fractions (especially medium or heavy gas oil) or residue, waste oil, used lube oil, etc. The resulting LIP blend stream 108 is thermally processed in step 110 and light product(s) 112 are obtained, depending on the nature of the thermal processing step 110. Thermal processing step 110 may comprise heating, distillation, cracking, alkylation, reforming, pyrolysis such as FCIP, and the like, including serial and/or parallel combinations thereof.

The LIP 102 is produced from a flash chemical ionizing pyrolysis (FCIP) process (see FIGS. 7-9 discussed below), e.g., the process referred to as catalytic pyrolysis in U.S. Pat. No. 10,336,946 B2. In any embodiment, the FCIP preferably comprises the steps of preparing an FCIP feed emulsion comprising (i) an oil component, (ii) a water component, and (iii) finely divided solids comprising a mineral support and an oxide and/or acid addition salt of a Group 3-16 metal (preferably $FeCl_3$ on an NaCl-treated clay), preferably 100 parts by weight of the oil component, from about 1 to 100 parts by weight of the water component, and from about 1 to 20 parts by weight of the finely divided solids; spraying the FCIP feed emulsion in a pyrolysis reactor, preferably at a temperature from about 425° C. to about 600° C., preferably 450° C. to 500° C.; collecting an effluent from the pyrolysis reactor; and recovering a product LIP from the effluent.

In any embodiment, the FCIP feed emulsion may preferably comprise from about 20 to about 50 parts by weight of the water, and/or from about 5 to about 10 parts by weight of the finely divided solids, per 100 parts by weight LIP-feedstock blend or other feed oil.

In embodiments, the finely divided solids may preferably comprise or be prepared as any of those catalysts disclosed in my earlier patent, U.S. Pat. No. 10,336,946 B2, which is hereby incorporated herein by reference. For example, the finely divided solids can comprise clay and/or a derivative from a clay, such as montmorillonite, for example, bentonite. The mineral support can be any other mineral disclosed in the '946 patent, including processed drill cuttings, albite, and so on. The metal can comprise a Group 3-16 metal, e.g., iron, lead, zinc, or a combination thereof, preferably a Group 8-10 metal, e.g., iron, cobalt, nickel or the like. In any embodiment, the finely divided solids may comprise an oxide and/or acid addition salt of a Group 8-10 metal supported on clay, preferably $FeCl_3$ on an NaCl-treated clay.

Preferably, the finely divided solids comprise ferric chloride ($FeCl_3$), montmorillonite, and a source of a salt that forms a eutectic with the $FeCl_3$. The montmorillonite is preferably a non-swelling clay such as calcium bentonite, and the salt is preferably NaCl, which may be provided as sodium ions from treating the calcium bentonite with NaCl brine and chloride ions provided by or with the $FeCl_3$. The finely divided solids are preferably the product of the method comprising the steps of: (a) treating iron with an aqueous mixture of hydrochloric and nitric acids to form a solids mixture of mixed valences of iron and iron chlorides, nitrites, nitrites, oxides, and/or hydroxides, preferably wherein the mixture has limited solubility in water and is acid soluble, (b) treating montmorillonite, preferably calcium bentonite, with brine, preferably NaCl brine and drying the treated montmorillonite; (c) combining the solids mixture with the treated montmorillonite to load the iron and/or iron chlorides, nitrites, nitrites, oxides, and/or hydroxides on the montmorillonite, preferably by incipient wetness or by adding an aqueous slurry of the solids mixture to the essentially dry montmorillonite; and (d) heat treating the loaded montmorillonite at a temperature above 400° C. up to the FCIP temperature, preferably 400° C. to 425° C. (see FIGS. 5-6 discussed below).

Preferably, the finely divided solids comprise $FeCl_3$ derived from the solids formed by the treatment of iron, preferably an excess of iron, with an aqueous mixture of hydrochloric and nitric acids to form a solids mixture optionally of mixed valences of iron and iron chlorides, nitrites, nitrites, oxides, and/or hydroxides. The admixture of equal weights (1:1 by weight) of iron and aqua regia ($HCl:H_2O:HNO_3$ at 3-6:2:1 by weight) forms $FeCl_3$, which is consistent with the dark violet to black coloration of the solids that is observed. The aqua regia is preferably slowly added to the iron, or may be added in several aliquots, to avoid excessive heat formation and reactant vaporization since the reaction is exothermic. The proportion of iron may be increased somewhat, but too much iron may form insufficient $FeCl_3$ as indicated by a generally brown or rust color. Greater proportions of aqua regia do not yield much if any benefit and thus may lead to lower yields of the solids mixture and/or excessive reagent costs. The admixture can also contain elemental iron, since the iron may be present in excess. Also, other iron chlorides, nitrates, nitrites, oxides, oxychlorides, hydroxides, or combinations and/or mixtures of these may also be present. For example, treatment of iron with aqua regia may in theory form the Fe(VI) compound hexachloroferrate. Further, since water is present, these compounds may be hydrated to varying degrees, e.g., especially upon slurrying with water, or decomposed by the water.

The $FeCl_3$ solids mixture preferably has limited solubility, e.g., less than 50 wt % will dissolve in hot water when mixed at a ratio of 1 g solids to 30 ml distilled water, preferably less than 40 wt %; and the $FeCl_3$ solids mixture preferably is acid soluble, e.g., more than 50 wt % will dissolve in 20 wt % aqueous HCl when mixed at a ratio of 1 g solids to 30 ml aqueous HCl, preferably at least about 65 wt %. The solids mixture may be dried, e.g., in an oven at a temperature above 100° C., for example, 100° C. to 150° C., and ground as needed. When the solids mixture is slurried in water and partially dissolved, the aqueous solution phase may comprise an excess of chloride ions, e.g., a molar ratio of chloride to total dissolved iron that is greater than 3:1, such as between 4 and 5 moles chloride per mole of solubilized iron. The aqueous phase of the slurry may also contain nitrite and/or nitrate in lesser amounts, e.g., 0.04-0.8 mole nitrite per mole of dissolved iron and/or 0.01-0.2 mole nitrate per mole of iron.

The montmorillonite support is preferably a non-swellable bentonite such as calcium bentonite. The bentonite is preferably treated with a brine to replace calcium ions with sodium, e.g., by treating the bentonite with 1 molar NaCl brine. The treated bentonite may then be dried, e.g., in an oven at a temperature above 100° C., for example, 100° C. to 150° C., and ground as needed to prepare it for loading with the $FeCl_3$ slurry by incipient wetness. The loading is thus achieved by mixing the $FeCl_3$ slurry with the dried NaCl-treated bentonite, which may form a paste. In this mixture, Na ions in the bentonite may theoretically be displaced with iron and/or iron complex cations to form, e.g., possible species such as Fe(III)$Cl_2$(—O—Si-bentonite) and/or $FeCl_5$(—O—Si-bentonite), or the like. The displaced Na ions can then theoretically react with excess chloride from the $FeCl_3$ solids mixture slurry to form NaCl.

The mix of $FeCl_3$ slurry and dried, NaCl-treated bentonite is then preferably heat treated or calcined. Heat treating the finely divided solids involves heating at a temperature above 200° C., such as from about 300° C. up to 600° C., for a period of time from less than 1 minute up to 24 hours or more, e.g., 1 to 16 hours. Heating at a temperature above 400° C. for a period of 4 to 6 hours is preferred. High temperatures above 400° C. are preferred to activate the solids, and may result in isolated Lewis and/or Bronsted acid sites in the bentonite being formed and/or other hydrate compounds, e.g., iron compound hydrates, may be dehydrated. Lower temperatures may result in insufficient activation or require longer periods of heating. Substantially higher temperatures may cause undesirable reaction, volatilization, and/or deactivation of the chemical species in the solids. Preferably, the heat treatment is at a temperature lower than the FCIP temperature, which may avoid premature reaction and/or deactivation of the solids material prior to FCIP, more preferably the heat treating is at a temperature of equal to or greater than 400° C. up to a temperature equal to or less than 425° C.

Although not wishing to be bound by theory, it is believed salts or ions present in the solids material can form a eutectic mixture with one or more metal compounds or reaction products thereof, especially where the metal compound melts or boils at the heat treatment temperature and the eutectic mixture is non-volatile. For example, where the metal compound includes $FeCl_3$, which has a normal boiling point of 315° C. and is thus normally quite volatile at 400°–425° C., the presence of NaCl or another salt may form a eutectic mixture of $FeCl_3$—NaCl with substantially lower volatility. This allows the $FeCl_3$ to remain on the support during heat treatment at 400°-425° C. and to be available as a reactant and/or catalyst at a higher pyrolysis temperature. Other iron compounds such as nitrates and/or nitrites may or may not decompose during the heat treatment step, e.g., to form iron oxides. In theory, similar eutectic systems such as $FeCl_3$—Na-bentonite may also form. Also, the $FeCl_3$ from the aqua regia treated iron has unexpectedly limited solubility in water suggesting that other complexes may be formed which could also limit volatility during heat pretreatment. As an example, the aqua regia-treated iron compounds might form covalent bonds with the bentonite, e.g., Fe(III)$Cl_2$(—O—Si-bentonite), to limit premature volatility.

The solids mixture of iron compounds or other $FeCl_3$ source may be loaded on the bentonite in an amount from 1 mg/kg to 10 wt %, for example, from about 1000 mg/kg to 5 wt %, preferably 2-4 wt %, based on the total weight of the finely divided solids.

Figure 2:
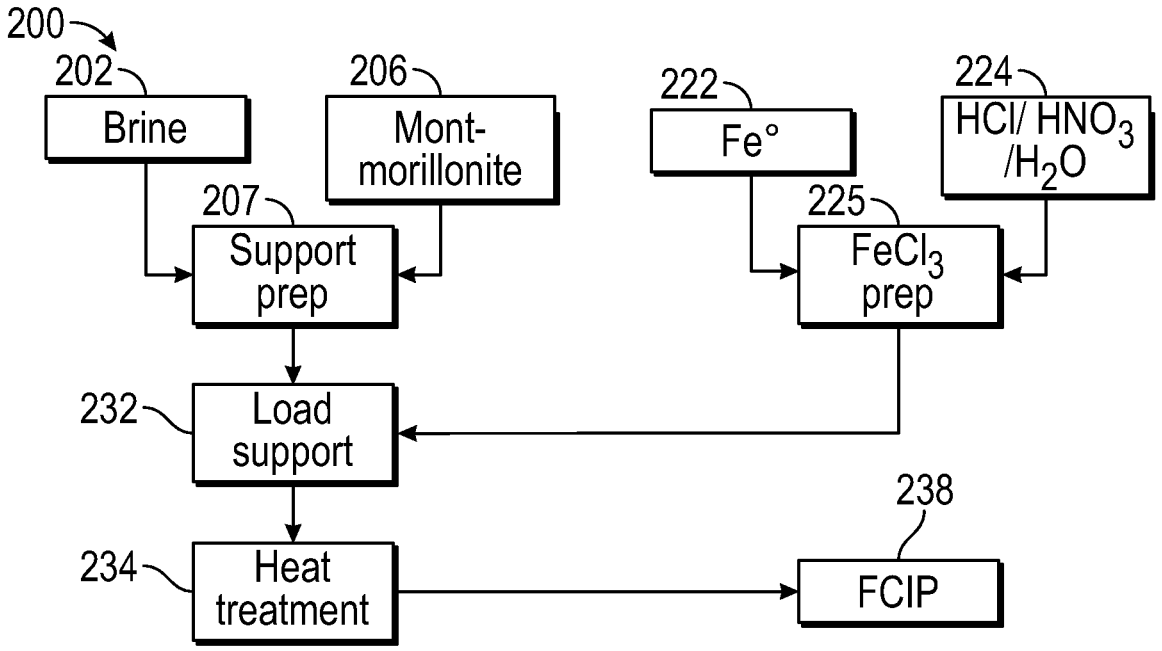
FIG. 2 shows a simplified schematic flow diagram of a method for preparing ferric chloride ($FeCl_3$) solids for FCIP, according to embodiments of the present invention.
Figure 3:
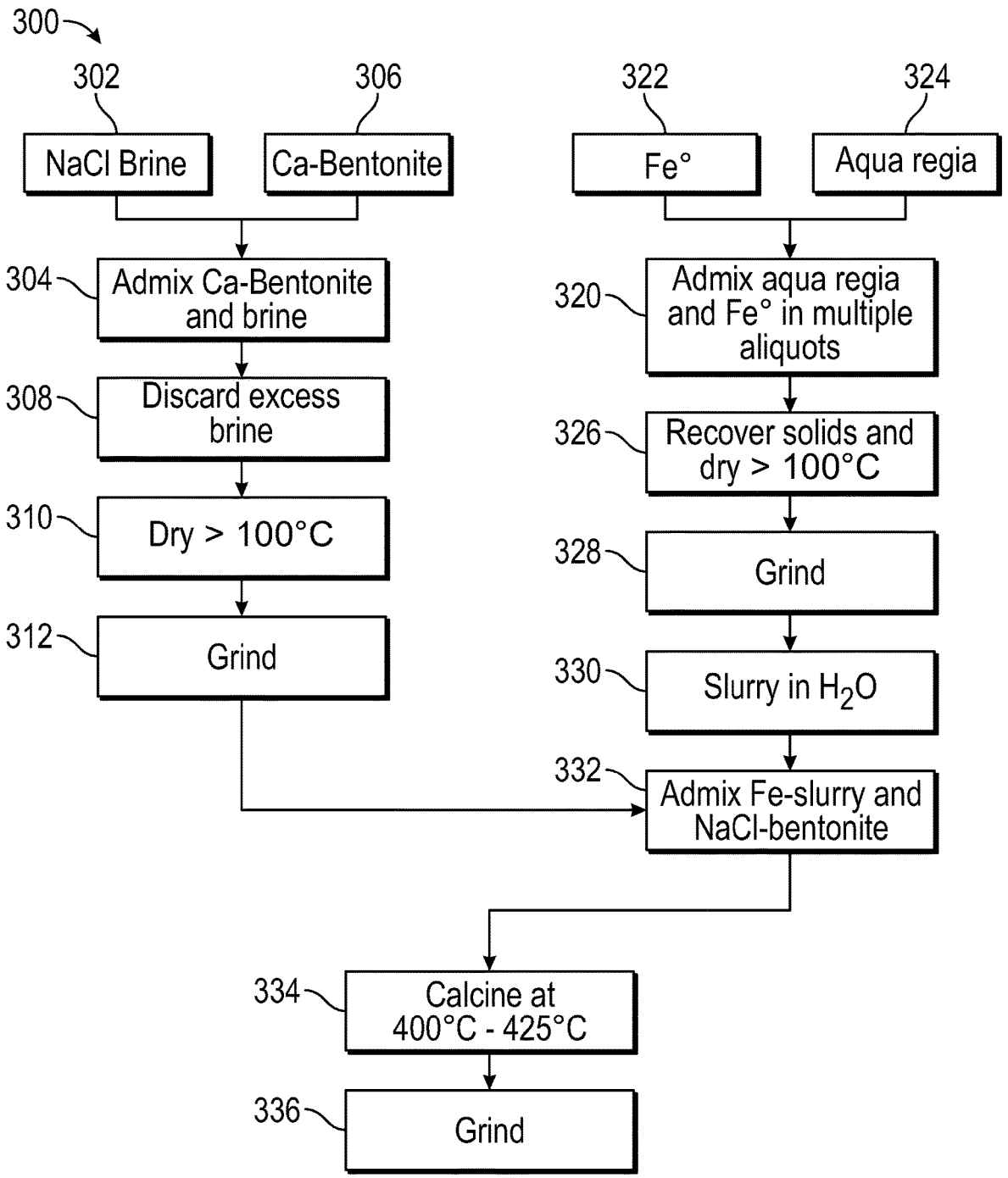
FIG. 3 shows a more detailed flow diagram of the preferred method shown in FIG. 2.

FIGS. 2 and 3 show the preparation of the finely divided solids in exemplary embodiments according to methods 200 and 300 for a laboratory or pilot plant scale production quantities. In the summarized method 200, brine 202, preferably NaCl brine, and montmorillonite 206, preferably bentonite, are admixed in support preparation step 207. Separately, iron 222 is treated with an aqueous mixture of HCl and $HNO_3$ in ferric chloride preparation step 225. The ferric chloride is loaded on the support in step 232, and the mixture is heat treated in step 234 prior to use in FCIP step 238.

In the more detailed method 300 seen in FIG. 3, brine 302, preferably 1M sodium chloride, is admixed in step 304 with calcium bentonite 306, preferably passing through a 100 mesh screen. Preferably, the weight ratio of Ca-bentonite to brine is 1:2. The mixture can be stirred, e.g., for 1 h, and allowed to stand, e.g., for 16-24 h. In step 308, the excess brine is discarded, e.g., by decantation and/or filtration, and in step 310 the solids are dried, e.g., dried in an oven at 120-130° C. for 4-6 h. When the NaCl-bentonite is dry, it can be optionally ground in step 312, e.g., to pass through an 80 mesh screen.

Separately a reduced iron complex is prepared. In step 320, finely-divided elemental iron 322, e.g., 100 mesh carbon steel shavings, are admixed with aqua regia 324, preferably at substoichiometric ratio where the moles of iron are greater than the total moles of HCl and $HNO_3$, e.g., at a weight ratio of 1:1 (Fe:aqua regia) where the aqua regia has a weight ratio of nitric acid:hydrochloric acid:water of about 1:3-6:2. The aqua regia is preferably added in 3 aliquots while stirring, and the temperature may increase, e.g., to about 95° C. In step 326, the solids can be recovered from the aqueous phase, e.g., by filtration, water washing, and drying, for example in an oven at 100° C. The aqua-regia-treated Fe solids ("AR-Fe") at this point can comprise a complex mixture of iron chlorides, nitrates, nitrites, and oxides with the iron in various valence states, e.g., Fe(0), Fe(II), Fe(III), and so on. The AR-Fe unexpectedly has a low fractional solubility in water so that no more than 40 wt %, preferably no more than about 35 wt % or 30 wt %, dissolves and/or digests in an aqueous mixture of 1 g AR-Fe in 30 ml total mixture (33.33 g/L) at 100° C., but has a high fractional solubility in 20 wt % aqueous hydrochloric acid such that at least 90 wt %, preferably at least about 95 wt % or 98 wt %, dissolves and/or digests in an aqueous mixture of 1 g AR-Fe in 30 ml total mixture (33.33 g/L) at 100° C.

In step 328, the filtered solids can be ground, e.g., to pass a 100 mesh screen, and in step 330 slurried in water, e.g., at 4 weight percent solids. Then, in step 332 the slurry from step 330 is admixed with the dry, ground NaCl-bentonite from step 312, e.g., at a weight ratio of 2:3 (slurry:NaCl-bentonite) to load the AR-Fe on the NaCl-bentonite by incipient wetness. The mixture from step 332 is then dried and calcined, e.g., at 400° C. for 2 h in step 334, cooled and ground in step 336, e.g., to pass an 80 mesh screen, and recovered as the supported iron-based solids 338.

In any embodiment of the invention, the FCIP process may comprise the steps of: (a) preparing an FCIP feed emulsion comprising 100 parts by weight of an oil component, from about 1 to 100 parts by weight of a water component, and from about 1 to 20 parts by weight of finely divided solids comprising a mineral support and an oxide or acid addition salt of a Group 3-16 metal (preferably $FeCl_3$ on an NaCl-treated clay); (b) spraying the FCIP feed emulsion in a pyrolysis reactor at a temperature from about 425° C. to about 600° C., preferably 450° C. to 500° C.; (c) collecting an effluent from the pyrolysis reactor; (d) recovering a product LIP from the effluent; I combining at least a portion of the product LIP with a feedstock oil to form an LIP blend comprising from 1 to 33.33 wt % of the product LIP; and (f) thermally processing the LIP blend to form a hydrocarbon product having an enriched yield of liquid hydrocarbons boiling at a temperature below 562° C., relative to separate thermal processing of the LIP and feedstock oil, relative to separate thermal processing of the LIP and feedstock oil, as determined by atmospheric distillation in a 15-theoretical plate column at a reflux ratio of 5:1, according to ASTM D2892-18 up to cutpoint 400° C. AET, and by vacuum potstill method according to ASTM D5236-18a above the 400° C. cutpoint to cutpoint 562° C. AET.

Preferably, the FCIP process further comprises supplying at least a portion of the LIP blend as the oil component to the FCIP feed emulsion preparation step (a) wherein the thermal processing step (f) consists of or comprises the spraying of the FCIP feed emulsion into the pyrolysis reactor of step (b).

In any embodiment of the invention, the FCIP process may comprise the steps of: (a) preparing an FCIP feed emulsion comprising (i) 100 parts by weight of an oil component comprising a feedstock oil and optionally from 1 to 50 wt % of an LIP, e.g., 1 to 50 wt % LIP and 99 to 50 wt % feedstock oil, preferably 5 to 35 wt % LIP and 95 to 85 wt % feedstock oil, more preferably 10 to 30 wt % LIP and 90 to 70 wt % feedstock oil, based on the total weight of the oil component, preferably where the percentages of LIP and feedstock oil total 100, (ii) from about 1 to 100 parts by weight of a water component, preferably 1 to 30 parts by weight water, and (iii) from about 1 to 20 parts by weight finely divided solids comprising a mineral support and an oxide or acid addition salt of a Group 3-16 metal (preferably $FeCl_3$ on an NaCl-treated clay); (b) spraying the FCIP feed emulsion in a flash pyrolysis reactor at a temperature from about 425° C. to about 600° C., preferably 450° C. to 500° C.; (c) collecting an effluent from the pyrolysis reactor; (d) recovering a product LIP from the effluent; and (e) optionally supplying a portion of the product LIP to the oil component in the feed emulsion preparation step (a).

While not wishing to be bound by theory, it is believed that hydrogen radicals and/or molecular hydrogen are generated in situ during flash pyrolysis by reaction and/or catalysis of one or more iron compound(s) and/or the support material. For example, where the ionizing solids comprise $FeCl_3$ on an NaCl-treated clay, hydrogen may be formed primarily by the decomposition of $FeCl_3$ vapor in the presence of steam, according to the following reactions:

$$2FeCl_3 \Leftrightarrow 2FeCl_2(s)+Cl_2$$

$$Cl_2+2H_2O \Leftrightarrow 2HClO+H_2$$

Here, the formation of hydrogen may be favored due to an excess of water (steam). Other hydrogen generating reactions, including the water-gas shift reaction ($CO+H_2O \leftrightharpoons CO_2+H_2$), the reaction of $FeCl_2$ with HCl, which may also be present in this system, the reaction of elemental iron and steam ($Fe+H_2O \leftrightharpoons FeO+H_2$), may occur to a limited extent, however, the residence time in the reactor, e.g. 0.1 to 2 seconds, and/or temperature (−25° C.-600° C.), may not be favorable for the reaction kinetics or equilibrium to form hydrogen by these mechanisms. Higher pyrolysis temperatures may not be favorable for hydrogen generation and/or may favor formation of undesirable byproducts such as HCl. Thus, the pyrolysis is preferably limited to 500° C. to maximize in situ hydrogen formation, more preferably 480° C., e.g., 450° C.-480° C.

In addition to the chemical production of hydrogen radicals by decomposition, $FeCl_3$ per se and bentonite can function as Lewis and/or Bronsted acids, and thus in theory can initiate ionic cracking reactions to form liquid ionizing pyrolyzate. Another possibility in theory is that iron compound(s) having higher oxidation states relative to $FeCl_3$ may be formed during the preparation of the iron compounds with aqua regia and/or during heat treatment, e.g., hexachloroferrate ion $(Fe(VI)Cl_3)^{3-}$ which might also help form ions and/or free radicals to propagate thermal and/or catalytic cracking reactions.

While not wishing to be bound by theory, it is believed that FCIP using the $FeCl_3$—NaCl-bentonite solids system at low pressure and a specific range of temperatures achieves extensive conversion of heavy hydrocarbons such as asphaltenes and/or resins to lighter hydrocarbons, and removal of heteroatoms such as nitrogen, sulfur, metals, etc., by reactions normally seen in high pressure catalytic cracking and hydrocracking, e.g., isomerization, cracking, dealkylation, aromatic saturation, decyclization, etc. For example, there is evidence that sulfur is both reduced, presumably by hydrogen radicals, and oxidized, presumably by reaction with HClO. The LIP product is unexpectedly characterized by low noncondensable gas yield, e.g., only small quantities of methane may be formed; the light products may be primarily $C_1$-$C_6$ hydrocarbons; small quantities of or no $C_{4+}$ olefins may be seen; and there may be significant formation of branched chain alkanes, isomerates, dealkylated aromatics, and naphthene cracking products. At the same time, the yield of coke can be minimized.

Liquid ionizing pyrolyzate (LIP) products obtained when a feedstock oil is processed by FCIP according to embodiments disclosed herein, especially when an oil with high contents of asphaltenes and/or resins is processed, include various medium-length hydrocarbon fractions having from about 12 to about 30 carbons, and various light oil fractions having from about 6 to 12 carbons. The LIP is thus enriched in hydrocarbons similar to those seen in catalytic and/or hydrocracking products.

Additionally, the LIP from the FCIP disclosed herein has an unexpectedly low viscosity for its density, compared to other hydrocarbons, suggesting the presence of relatively high levels of isomerates. Moreover, blends of the LIP with other crude oils, heavy oils, residues, and the like also have an unexpectedly low viscosity compared to conventional crude oil blends. Applicant is not bound by theory, but believes there may be ionized species in the LIP such as stable radicals that can inhibit asphaltene aggregation and/or decyclize asphaltenes, which is reflected in a significant reduction in coking tendency. The asphaltenes and other hydrocarbon molecules subjected to FCIP can form relatively stable free radical species, and can also form hydrogen donor species such as hydroaryl compounds. Some rearrangement of molecules appears to occur at ambient temperatures upon blending, whereas at moderate thermal processing temperatures, e.g., 100-250° C., the free radicals and hydrogen donors can facilitate conversion to saturates, aromatics, and lube oil base stock molecules, and reducing the amount of Conradson carbon residue and coke make.

In any case, when a feedstock oil is blended with the LIP, the viscosity reduction and reduced tendency to form coke results in unexpected improvements in thermal processing. For example, a crude-LIP blend can be heated more rapidly, e.g., during preheating for feed to the distillation column, since fouling from coke formation and deposition is markedly reduced. Distillation of a crude-LIP or resid-LIP blend results in liquid oil yields that are substantially and synergistically higher, and resid yields that are substantially and synergistically lower, than could be obtained by separate distillation of the LIP and crude or resid. Flash pyrolysis of a crude-LIP or resid-LIP blend, by FCIP as described herein, or otherwise, likewise results in similarly increased yields of liquid oil products and decreased yields of coke and also noncondensable gases. Unexpectedly, the resid from thermal processing of such LIP-modified blends exhibits a remarkably low viscosity, suggesting it contains an unusually high proportion of lube oil base stock. Moreover, the production of olefins by FCIP can be controlled by the selection of appropriate operational parameters, e.g., increasing the water content in the emulsion feed to the pyrolysis reactor and/or increasing the pyrolysis temperature can produce relatively larger amounts of olefins such as ethylene and propylene.

Figure 4:
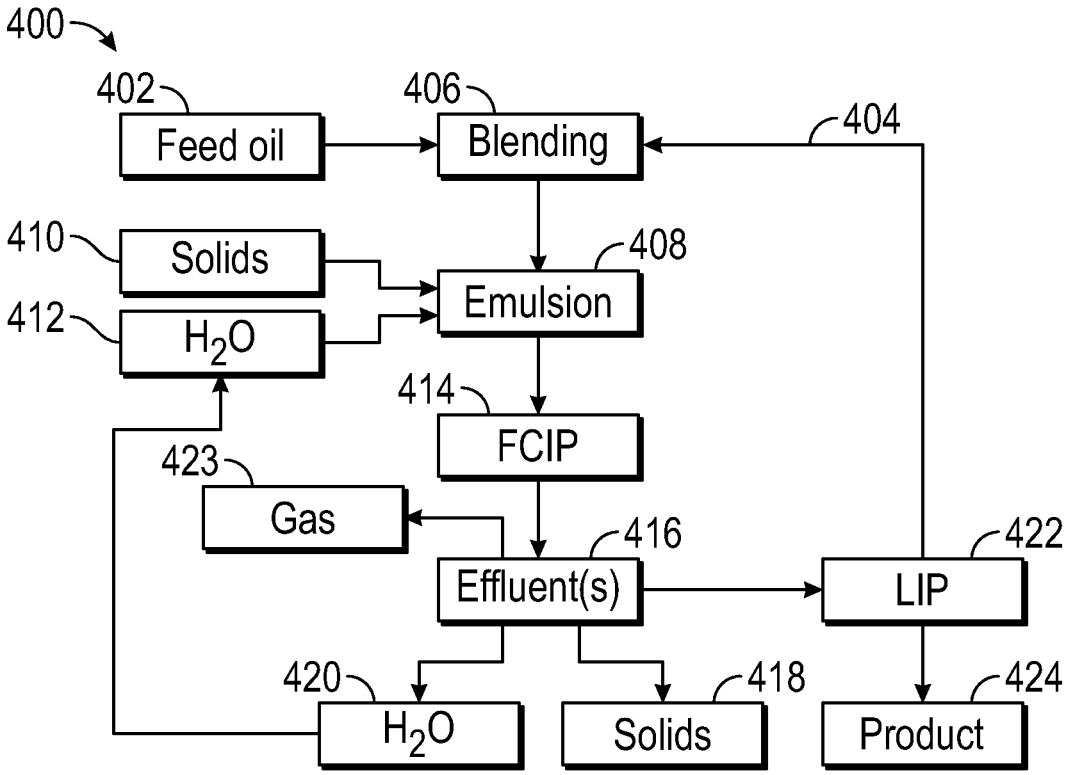
FIG. 4 shows a schematic flow diagram of a hydrocarbon conversion process wherein an LIP is combined with a feedstock oil to form an LIP blend and the LIP blend is thermally processed, according to embodiments of the present invention.

With reference to the embodiment of the invention shown in the simplified schematic flow diagram of FIG. 4, in FCIP process 400, feed oil 402 and liquid ionizing pyrolyzate (LIP) from stream 404 are optionally blended in step 406 or otherwise fed separately to emulsification in step 408 with finely divided solids 410 and water 412. The emulsion from step 408 is supplied to FCIP step 414. One or more effluents are separated in step 416 to obtain solids 418, water 420, LIP 422, and noncondensable gas 424.

The feed oil 402 can be any hydrocarbon liquid suitable for FCIP 414, such as, for example, crude oil, petroleum distillation fractions, especially medium or heavy gas oil or residuum, waste oil, used lube oil, etc. When the feed oil 402 is crude oil, it is advantageously un-desalted since the inorganic components do not appear to adversely impact FCIP 414 and much of the inorganics can be recovered with the solids from FCIP. Since the inorganics are removed in FCIP process 400, the load on the desalter associated with treatment of the crude oil for feed to an atmospheric distillation can be reduced by the amount fed to the FCIP process 400. Moreover, the water content of the crude oil does not impact the FCIP 414 since the feed is in the form of an oil/water emulsion. In fact, it is preferred to use the water or brine from desalting as all or part of the water 412 for the emulsion preparation, thereby reducing the load on the desalter and reducing the amount of water that must be added to the emulsion in step 408. Further, the salt may form a eutectic mixture with one or more of the other additive components, e.g., $FeCl_3$, or otherwise enhance the catalytic and/or reactive activity of the finely divided solids.

The LIP 422 may optionally be supplied to the blending and/or emulsion steps 406, 408 via stream 404 along with or in lieu of another LIP stream from another FCIP source (e.g., see FIGS. 3-4). The remaining LIP 424 can be optionally thermally processed by heating, distillation, cracking, visbreaking, coking, alkylation, reforming, etc. and/or directly supplied as product(s). If desired, water 420 recovered from the effluent may be recycled to the supply 412 and/or step 408 for the FCIP feed emulsion.

Preferably, a portion of the oil component in the FCIP feed emulsion from step 408 comprises a recycled portion of the product LIP via line 404. If used, the LIP can be used in the blend in a weight proportion of LIP 404:feed oil 402 of from 1:100 to 1:1, preferably in an amount from 1 to 40 wt % based on the total weight of the oil components supplied to the FCIP feed emulsion step 208, e.g., 1 to 40 wt % product LIP and 99 to 60 wt % feed oil, preferably 5 to 35 wt % product LIP and 95 to 65 wt % feed oil, more preferably 10 to 30 wt % product LIP and 90 to 70 wt % feed oil, based on the total weight of the oil component, preferably where the percentages of product LIP and feed oil in the LIP blend total 100.

One advantage of using emulsion 408 is that the oil, water, and finely divided solids are intimately mixed prior to vaporization of the oil and water, which are in close contact with the solids, and the solids are already well-dispersed in liquid, promoting fluidization in the gas phase. Another advantageous feature of the present invention is that in some embodiments the emulsion 408 can have a viscosity that is lower, preferably an order of magnitude lower, than the corresponding oil components, which facilitates preparation, pumping, spraying, conversion, yield, etc., and can avoid adding solvent or diluent. For example, the feed mixture may be an emulsion having an apparent viscosity at 30° C. and 100 $s^{-1}$ at least 30% lower than the oil component alone. In embodiments, the emulsion has a viscosity of less than or equal to about 50 Pa-s (50,000 cP) at 25° C., or less than or equal to about 20 Pa-s at 25° C., or less than or equal to about 300 mPa-s (300 cP) at 130° C., or less than about 250 mPa-s at 130° C. Accordingly, the emulsion may include heavy oil emulsified with water and the finely divided solids to produce a pumpable emulsion which facilitates adequate and uniform injection of the feed mixture into the pyrolysis chamber.

Also, in some embodiments the emulsion 408 can have a high stability that inhibits separation into oil or water phases and solids precipitation, which might otherwise result in a buildup of asphaltenes, wax, mineral particles, etc. The stability can facilitate advance preparation and storage of the emulsion 408. For example, the feed mixture 408 can be an emulsion having an electrical stability of equal to or greater than 1600 V, when determined according to API 13B-2 at 130° C., preferably greater than 1800 V or even greater than 2000 V. If desired, the emulsion may further comprise an emulsifying agent such as a surfactant or surfactant system. Preferably, the emulsion is substantially free of added surfactant.

In some embodiments, the process comprises first mixing the feed oil 402 (or blend from step 406) and the finely divided solids 410, and then mixing the water 412 with the mixture of the oil and finely divided solids. Preferably, the process further comprises passing (e.g., pumping) the feed mixture through a line to the reactor, as opposed to mixing the oil, water, and/or finely divided solids together in the reactor 414, e.g., introducing them separately and/or at a nozzle used for spraying the mixture. In embodiments, the heavy oil is combined with the water and the finely divided solids to form the feed mixture at a temperature of about 25° C. to about 100° C., e.g., 30° C. to 95° C. The emulsion 408 may be fed to the FCIP reactor 414 at a relatively high temperature to minimize viscosity and enhance rapid heating in the pyrolysis chamber, but below boiling, e.g., 40° C. to 60° C.

An exemplary process according to embodiments of the present invention comprises the steps of preparing the FCIP feed emulsion 408 comprising (i) 100 parts by weight of the oil component which comprises from 1 to 50 wt % of the LIP, preferably 5 to 40 wt % LIP, based on the total weight of the oil component, (ii) from about 1 to 100 parts by weight of the water component 412, and (iii) from about 1 to 20 parts by weight finely divided solids 410 comprising a mineral support and an oxide or acid addition salt of a Group 3-16 metal (preferably $FeCl_3$ on an NaCl-treated clay); spraying the FCIP feed emulsion from step 408 in a pyrolysis reactor 414 at a temperature from about 425° C. to about 600° C. (preferably about 450° C. to about 500° C.); collecting effluent(s) 416 from the pyrolysis reactor 414; recovering a product LIP 422, 424 from the effluent 416; and optionally supplying a portion 404 of the product LIP 422 to the feed emulsion preparation step 408 and/or optionally supplying the LIP portion 404 to the blending step 406. Higher amounts of water in the emulsion 408, e. g., more than 50 parts by weight, tend to produce more hydrocarbon gases, which may be preferred where olefin production is preferred.

In embodiments, the absolute pressure in the FCIP reactor 414 is from below atmospheric or about atmospheric up to about 5 atm, or preferably up to about 3 atm, or more preferably up to about 2 atm, or especially up to about 1.5 atm (7-8 psig). For example, the pressure in the FCIP reactor 414 can be about 1 to 3 atm, preferably 1 to 1.5 atm. The higher pressures are less preferred since they require more expensive equipment to handle them and may inhibit reactions necessary for forming the conversion-promoting and/or coke-inhibiting components in the product LIP 422.

The FCIP reactor 414 is operated and/or pyrolyzate exits from the reactor 414 preferably at a temperature between about 425° C. and about 600° C., more preferably between about 450° C. and about 500° C. The lower temperatures tend to favor more liquid hydrocarbon products and less gas, but total conversion may also be lower. Conversely, the higher temperatures tend to favor more conversion but hydrocarbon gas formation, including olefins, is greater and liquid hydrocarbon yield is less. The temperature depends on the hydrocarbon products desired: for greater liquid hydrocarbon yields, a temperature of 450° C. to 500° C. is preferred, 450° C. to 480° C. more preferred; for higher olefin and/or other light hydrocarbon yields, 500° C. to 600° C. is preferred.

In some embodiments, the heating of the reactor 414 and/or emulsion 408 can be direct by contact with a hot gas such as a combustion effluent, and/or in indirect heat exchange relationship with the combustion gas or by using an electrical or induction heating. In direct heating, the flue gas preferably comprises less than about 3 vol % molecular oxygen, or less than about 2 vol % molecular oxygen, or less than about 1 vol % molecular oxygen.

In some embodiments, the process comprises injecting the emulsion into the reactor, e.g., using an atomizing nozzle, and in some embodiments the injection is into a stream of combustion flue gases or other hot gas in direct heat exchange to promote rapid heating and mixing, e.g., countercurrently sprayed upstream against an oncoming flow of the combustion gas, for example, spraying the emulsion downwardly against an upward flow of the hot gas from below. If desired the combustion flue gases or other hot gas can be introduced into a lower end of a reactor vessel housing the pyrolysis zone, e.g., through a gas inlet through a side or bottom wall of the reactor. Regardless of heating mode, when sprayed downwardly into the reactor, the residue and solids can accumulate in the bottom of the reactor, and periodically or continuously removed from the reactor, for example, through an outlet for continuous or periodic removal of the solids, e.g., using a rotary valve in the outlet.

In some embodiments, especially where the feedstock oil is a heavy crude oil or very heavy crude oil, the pyrolyzate vapor phase preferably comprises a condensate upon cooling having an overall API gravity greater than 20° API or greater than 22.3° API or greater than 26° API. In some embodiments, the process further comprises cooling the pyrolyzate vapor phase to form a condensate, and collecting the condensate, wherein the condensate has an overall API gravity greater than 20° or greater than 22.3°.

In some embodiments, the pyrolyzate vapor phase comprises hydrocarbons in an amount recoverable by condensation at 30° C. of at least about 70 parts (preferably 80 parts, more preferably 90 parts) by weight per 100 parts by weight of the oil in the feed mixture, and especially greater than 100 parts by weight liquid hydrocarbons per 100 parts by weight of the oil. Liquid hydrocarbon yields in excess of 100% of the feed oil are made possible by incorporating hydrogen and/or oxygen (from the water), especially hydrogen, into the product oil, and minimizing gas and residue formation. In some embodiments, the pyrolyzate vapor phase comprises less than 5 vol % of non-condensable (30° C.) hydrocarbon gases based on the total volume of hydrocarbons in the pyrolyzate vapor phase (dry basis).

In embodiments, the feed oil 402 can be a crude oil, including heavy crude oil, extra heavy crude oil, tar, sludge, tank bottoms, spent lubrication oils, used motor crankcase oil, oil based drill cuttings, oil recovered from oil based drill cuttings, etc., including combinations and mixtures thereof. In embodiments, the feed oil has an API gravity of less than 22.3° API or less than 20° API or less than 10° API. In embodiments, the heavy oil has a viscosity greater than 10,000 cP, or greater than 50,000 cP, or greater than 100,000 cP, or greater than 300,000 cP, whereas the LIP 422 can have a viscosity less than 1000 cP, or less than 100 cP, or less than 30 cP.

As mentioned above, the feed oil need not be dewatered or desalted and can be used with various levels of aqueous and/or inorganic contaminants. Any water that is present, for example, means that less water needs to be added to form the emulsion 408 to obtain the desired water:oil ratio. The salts and minerals that may be present in crude oil do not appear to adversely affect results. These embodiments are particularly advantageous in being able to process waste emulsions or emulsions such as rag interface that is often difficult to break. Considering that the industry goes to great lengths to break emulsions into clean oil and water phases, feeding such emulsions in the feed mixture herein to the reactor can avoid the need to break such emulsions altogether, or at least reduce the volume of emulsion that must be separated. For example, the rag layer that often forms at the interface between the oil and water, that is often quite difficult to separate, can be used as a blend component in the feed emulsion step 408.

In some embodiments of the present invention, a hydrocarbon refinery process comprises the steps of: (a) combining an LIP with a feedstock oil to form an LIP blend comprising from 1 to 50 wt % LIP and 99 to 50 wt % feedstock oil, preferably 5 to 35 wt % LIP and 95 to 65 wt % feedstock oil, more preferably 10 to 30 wt % LIP and 90 to 70 wt % feedstock oil, based on the total weight of the oil component, preferably where the percentages of LIP and feedstock oil total 100; (b) preparing an FCIP feed emulsion comprising (i) 100 parts by weight of a first portion of the LIP blend, (ii) from about 1 to 100 parts by weight of a water component, and (iii) from about 1 to 20 parts by weight finely divided solids comprising a mineral support and an oxide or acid addition salt of a Group 3-16 metal (preferably $FeCl_3$ on an NaCl-treated clay); (c) spraying the FCIP feed emulsion in a flash pyrolysis reactor at a temperature from about 425° C. to about 600° C., preferably 450° C. to 500°

C.; (d) collecting an effluent from the flash pyrolysis reactor; (e) recovering a product LIP from the effluent; (f) incorporating at least a portion of the product LIP into the LIP blend; and (g) distilling a second portion of the LIP blend. The feedstock oil preferably comprises crude oil, more preferably un-desalted crude oil, e.g., the process may further comprise water washing to desalt the second portion of the LIP blend, and distilling the desalted second portion of the LIP blend in step (g).

In some embodiments of the present invention, a hydrocarbon refinery process comprises the steps of: (a) preparing an FCIP feed emulsion comprising (i) 100 parts by weight of an oil component, (ii) from about 5 to 100 parts by weight of a water component, and (iii) from about 1 to 20 parts by weight finely divided solids comprising a mineral support and an oxide or acid addition salt of a Group 3-16 metal (preferably $FeCl_3$ on an NaCl-treated clay); (b) spraying the FCIP feed emulsion in a pyrolysis reactor at a temperature from about 425° C. to about 600° C., preferably 450° C. to 500° C.; (c) collecting an effluent from the pyrolysis reactor; (d) recovering LIP from the effluent; (e) combining the recovered LIP with a feedstock oil comprising a petroleum fraction selected from medium weight gas oil, heavy gas oil, resid, or a combination thereof to form an LIP blend; and (f) distilling, cracking, visbreaking, and/or coking the LIP blend. Preferably, the oil component in the feed emulsion from the preparation step (a) comprises the petroleum fraction used in step (d), e.g., the feed emulsion from step (a) may comprise the LIP blend from the combining step (e).

Figure 5:
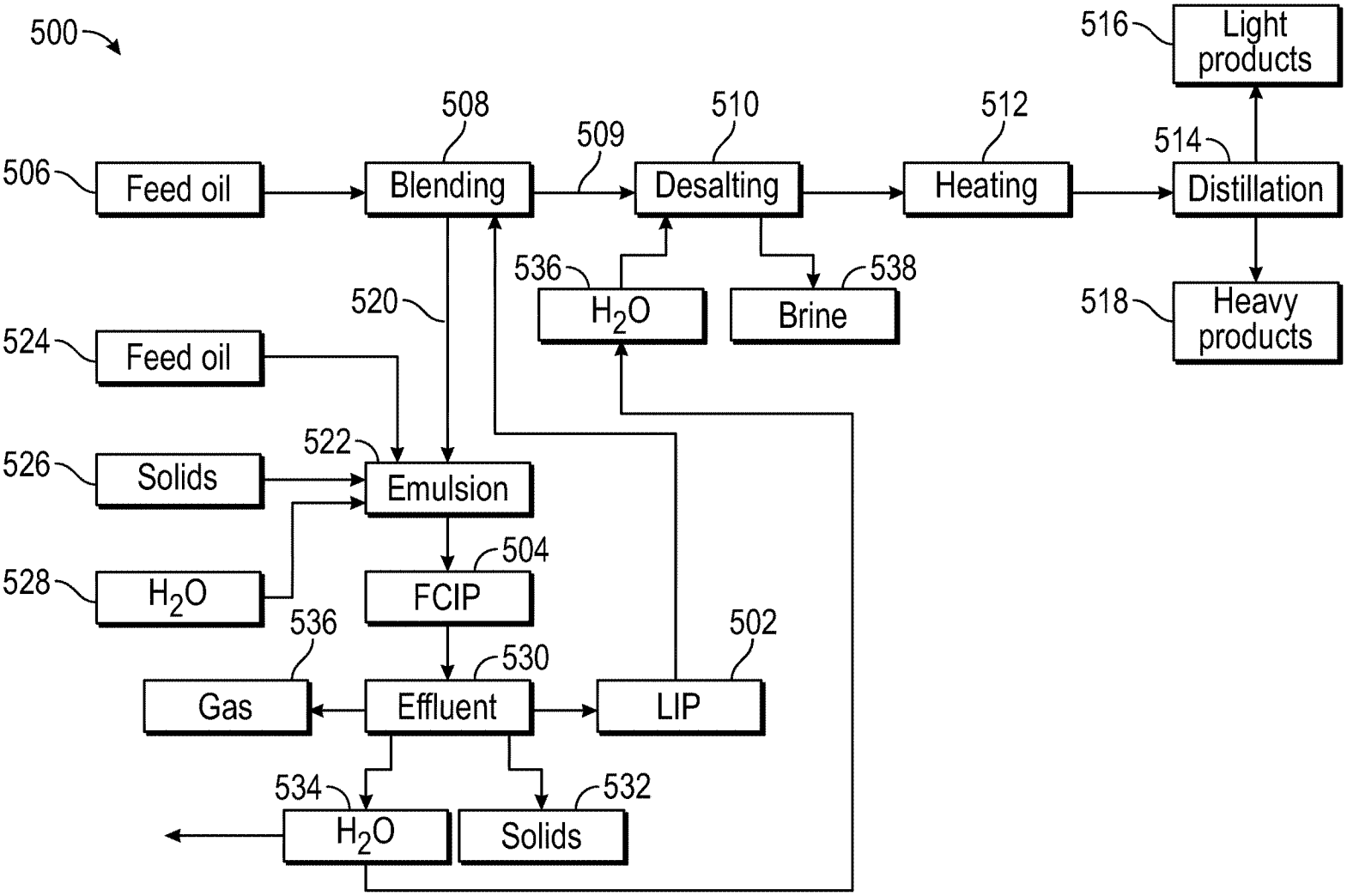
FIG. 5 shows a schematic flow diagram of a hydrocarbon refinery process wherein LIP from FCIP is blended with feed oil, desalted, heated, distilled, and optionally supplied to the emulsion preparation step for FCIP, according to embodiments of the present invention.

With reference to the embodiment of the invention shown in the simplified schematic flow diagram of FIG. 5, a hydrocarbon refinery process 500 comprises combining a liquid ionizing pyrolyzate (LIP) 502 from FCIP 504 with a feed oil 506 in step 508 to form an LIP blend comprising the LIP. A first portion 520 of the LIP blend from 508 is supplied for FCIP 504, and a second portion 509 for distillation 514.

The LIP can be used in the blend in a weight proportion of LIP 502:feed oil 502 of from 1:100 to 1:1, e.g., or from 1:20 to 1:2, preferably in an amount from 1 or 5 to 35 wt %, e.g., about 10 to 30 wt %, based on the total weight of the feed oil 506 and LIP 502 supplied to the blending step 508. Lesser amounts of the LIP have diminishing improvement of the blend, whereas higher amounts may not be economically attractive.

Surprisingly, it has been found that a blend of the LIP and crude oil can have a substantially lower viscosity than would be expected from traditional API viscosity prediction methods for blends.

The first LIP blend portion 520 can be pyrolyzed in FCIP 504. In step 522, there is prepared an FCIP feed emulsion comprising (i) 100 parts by weight of the first portion 520 of the LIP blend, (ii) from about 1 to 100 parts by weight water, and (iii) from about 1 to 20 parts by weight finely divided solids comprising a mineral support and an oxide or acid addition salt of a Group 3-16 metal (preferably $FeCl_3$ on an NaCl-treated clay), e.g., from about 5 to about 50 parts by weight of the water, and from about 1 to about 10 parts by weight of the finely divided solids, per 100 parts by weight of the LIP blend. In step 504, the FCIP feed emulsion from 522 is injected, preferably sprayed, in a pyrolysis reactor at a temperature from about 425° C. to about 600° C. An effluent 530 is collected from the pyrolysis reactor, a product LIP 502 is recovered from the effluent, and at least a portion is incorporated into the LIP blend in step 508 as mentioned above.

Feed oil 524, which can be the same feed oil as 506 or another oil source can optionally be supplied to the emulsion step 522 along with or in lieu of stream 520. Where blend stream 520 and feed oil 524 are both used, they can optionally be blended together in a vessel or line (not shown) before the emulsion step 522. Preferably, the blend stream 520 is the exclusive oil source for the emulsion 522 fed to FCIP 504, i.e., feed oil 524 is not supplied to the emulsion 522, thereby avoiding a duplication of oil blending equipment.

The emulsion step 522 emulsifies the blend stream 520 and/or feed oil 524 with finely divided solids 526 and water 528. The emulsion is pyrolyzed in FCIP step 504, and separated in step 530 to obtain solids 532, water 534, LIP 502, and noncondensable gas 536. Use of the blend stream 520 in this manner can facilitate pyrolysis by reducing fluid viscosities, improving emulsion stability, enhancing atomization, improving conversion, improving liquid yield of LIP 502, and improving the isomerization and/or alkylation promoting qualities of the product LIP 502, relative to the feed oil 506 and/or feed oil 524.

The second portion 509 of the LIP blend from 508 is fractionated in distillation 514. In any embodiment, the feed oil 506 may be a crude oil, preferably un-desalted crude oil, preferably where the process further comprises water washing in step 510 to desalt the second portion 509 of the LIP blend, preheating the crude in step 512, and distilling in step 514 to obtain light and heavy products 516, 518. In practice, the crude is often partially preheated to reduce viscosity, desalted, and then preheated to the distillation feed temperature. The distillation step 514 can include atmospheric and/or vacuum distillation, with which the skilled person is familiar.

Desalting 510 of the LIP blend portion 509 is facilitated due to lower salt and water content, synergistically lower viscosity and lower density, relative to the feed oil 506 by itself, and can thus be separated from water or brine more readily than the crude. Because some of the inorganic contaminants are removed by FCIP 504 from the first portion 520, the load on the desalter 510 is likewise reduced. If desired, the water 536 for the desalting 510 may come from the FCIP water 534, and/or the brine 538 may be supplied to water 528 for preparing the emulsion in 522.

Heating 512 can likewise be improved by less tendency to form coke or otherwise foul the heat transfer surfaces, allowing a higher differential temperature to be applied. To avoid this, refineries often use a series of heaters, e.g., more than a dozen, to incrementally raise the crude to the desired temperature. The LIP blend may reduce the number of heaters required. Also, the LIP blend has an unexpectedly lower viscosity and may provide higher heat transfer coefficients. Finally, distillation 514 is improved by providing a higher yield of light products 516, a lower yield of heavy products 518, and improved quality of both the light and heavy products 516, 518. For example, the lighter products 516 tend to have an unexpectedly high proportion of the type of hydrocarbons normally obtained by isomerization and/or alkylation, which can be reflected in a lower density, lower viscosity, higher viscosity index, etc.

Figure 6:
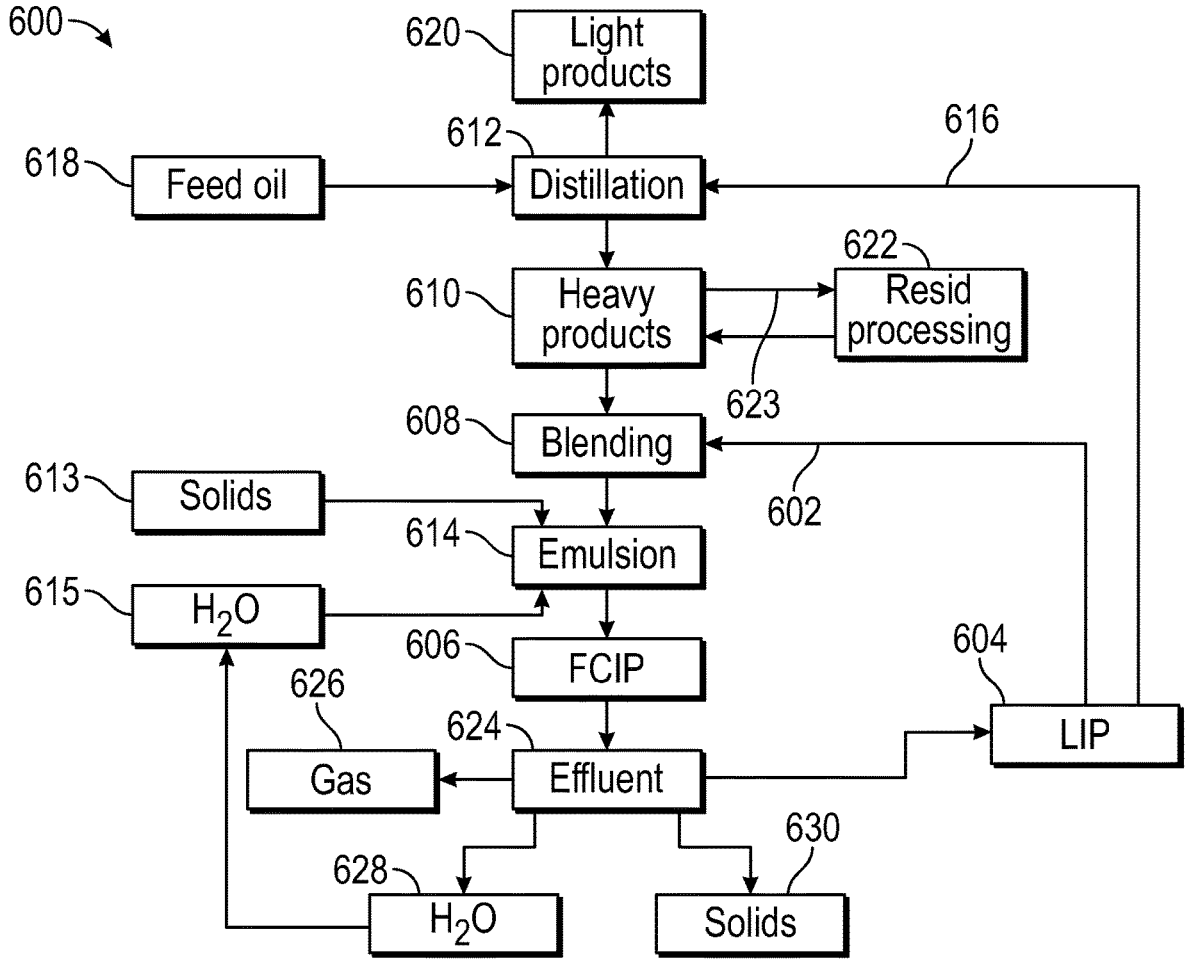
FIG. 6 shows a schematic flow diagram of a hydrocarbon refinery process wherein a first portion of LIP from FCIP is blended with heavy products from distillation, supplied to the emulsion preparation step for FCIP, and a second portion is optionally supplied to the distillation step, according to embodiments of the present invention.

With reference to the embodiment according to the present invention shown in the simplified schematic flow diagram of FIG. 6, a hydrocarbon refinery process 600 is shown in which (i) a blend of the heavy products 610 from distillation 612 and a portion 602 of the product LIP 604 is treated in FCIP 606 for improved conversion, liquid yield, and LIP quality, and a reduction in the amount of coke that is formed, relative to treatment of the heavy products 610 alone and especially relative to conventional processing of the heavy products 610, e.g., in a delayed coker; and/or (ii)

a portion 616 of the product LIP 604 is supplied to distillation 612 for improved yield and quality of distillates, and a reduction in the yield of the heavy products 610 and/or the amount of coke that is formed, relative to distillation of the feed oil 618 alone.

Optionally, the feed oil 618 used for distillation 612 can be processed for feed to the distillation 602 in the manner as shown in FIG. 5 for the feed oil 506 in process 500 that is fed to distillation 514. In this arrangement, FIG. 5 can be seen as the front end or pretreatment of the crude supplied in a blend with the LIP to the distillation 514, 612, and FIG. 6 as a downstream processing of the heavy products 518, 610 from distillation 514, 612. In other words, processes 500 and 600 can be integrated where distillation 514 and 612 are equivalent, light products 516 and 620 are equivalent, and heavy products 518 and 610 are equivalent. The feed oil 618 is preferably a washed, preheated crude oil, e.g., the oil from heating step 512 in FIG. 5.

A first portion 602 of LIP 604 from FCIP 606 can be blended in step 608 with heavy products 610 from distillation 612. The blend and finely divided solids 613 are supplied with water 615 to the emulsion preparation step 614 for the FCIP 606.

A second portion 616 of the LIP 604 is optionally collected as a product stream and/or supplied to the distillation 612 for improved conversion of the feed oil 618 to light products 620 from the distillation, improved yield and quality of light products 620, and decreased yield of heavy products 610 and/or a reduced flow rate to resid processing 622. If desired, the LIP in stream 616 may be blended in step 508 with the feed oil 618 (corresponding to feed oil 506 in FIG. 5) upstream from the desalting 510, heating 512, and so on. When the LIP 604 derived from the heavy product 610 in FIG. 6 is supplied to the blending 508 in FIG. 5, the treatment loop through line 520 to FCIP 504 and return from LIP 502 may or may not be used, and if used, the processing rate through FCIP 504 may be reduced in size relative to the flow scheme of FIG. 3 alone.

Effluent 624 from FCIP 606 is separated to recover LIP 604, noncondensable gas 626, water 628, and solids 630. Recovered water 628 may optionally be supplied for re-use as the water 615 fed to the emulsion step 614 and/or water 528 (see FIG. 5).

Figure 7:
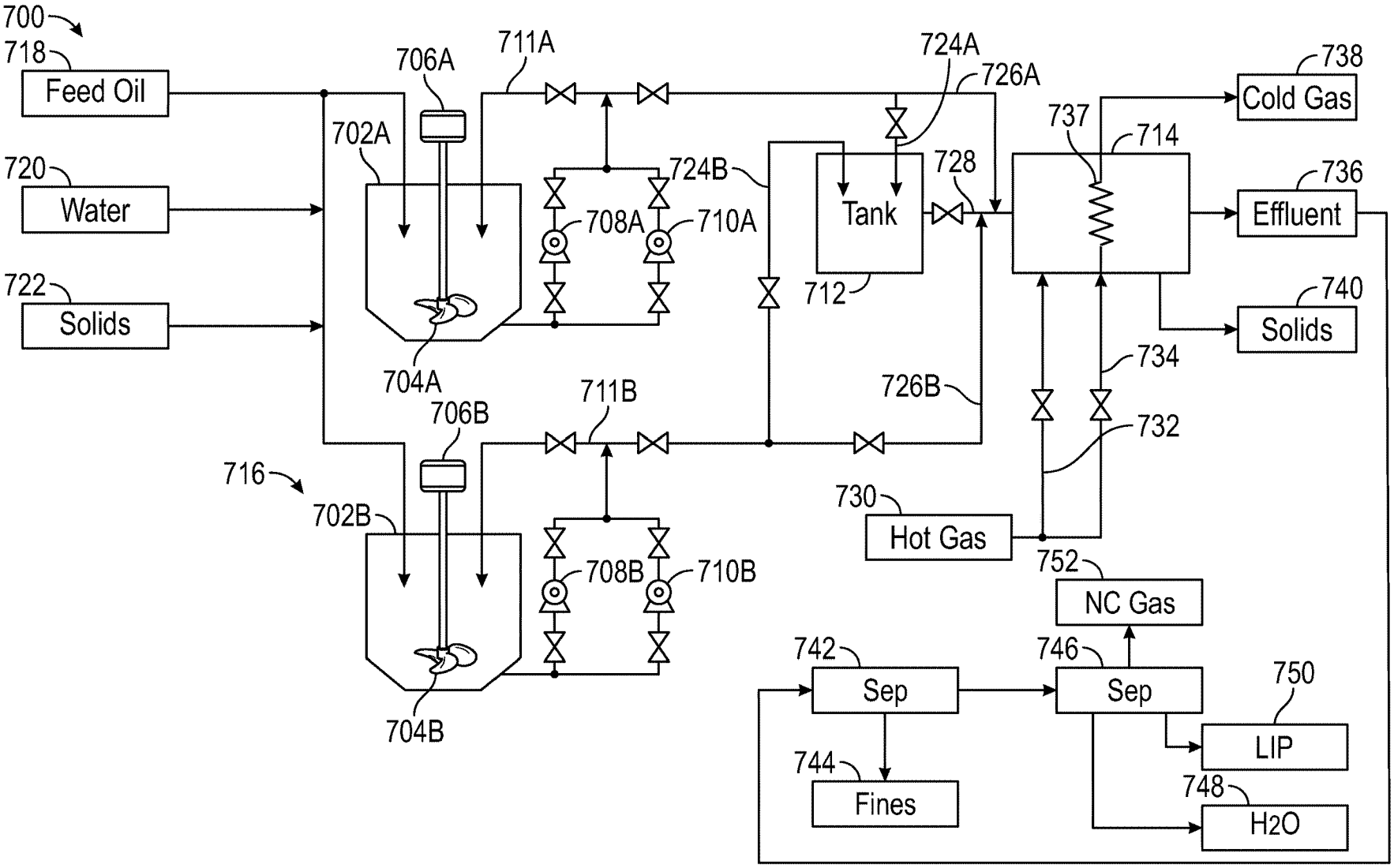
FIG. 7 shows a schematic flow diagram of an FCIP process for making the LIP, according to embodiments of the present invention.

With reference to FIG. 7, an apparatus 700 that may be used to prepare the feed mixture in accordance with some embodiments of the present invention comprises a mixing tank 702A equipped with an agitator 704A, which may be driven by motor 706A. If desired, redundant pumps 708A, 710A can be provided with valved lines for selective recirculation and transfer to an optional holdup tank 712 and/or directly to reactor 714. If desired, an optional second mixing train 716, including mixing tank 702B, agitator 704B, motor 706B, and pumps 708B, 710B, can be provided to facilitate batch, semi-batch or continuous feed mixture preparation.

In batch operation, feed oil 718, water 720, and finely divided solids 722 are charged to the mixing tank 702A (or 702B) in any order, preferably by transferring the feed oil into the mixing tank, then the finely divided solids, and then the water while maintaining agitation via agitator 704A (or 704B) and/or providing agitation before and/or after each addition. One of the pumps 708A, 710A (708B, 710B) can recirculate the mixture via valved line 711A (711B) while agitating to facilitate mixing. Once the mixture has been prepared, the pumps 708A, 710A (708B, 710B) can transfer the mixture to holding tank 712 via valved line 724A (724B), or directly to FCIP reactor 714 via valved lines 726A (726B) and 728.

If desired, the feed oil 718 may be heated or mixed with a hydrocarbon diluent to reduce viscosity and facilitate pumping and mixing. The water 720 and/or finely divided solids 722 may also be optionally heated to facilitate mixing. Also, if desired, the tanks 702A, 702B, 712 and the associated lines and pumps may also be heated to keep the viscosity of the mixture low; however, the mixture in some embodiments has a lower viscosity than the feed oil 718, so it may be possible to maintain a lower temperature for the mixture or to avoid heating altogether. Furthermore, the mixing operation may be exothermic providing a source of heat in situ for the mixture. Moreover, the emulsion of the feed mixture is stable in some embodiments and so it may be prepared in advance, e.g., up to several days or more, and stored until use without phase separation, before transfer to the tank 712 and/or reactor 714. The emulsion can also be prepared off-site and pumped or trucked to the pyrolysis site. The feed mixture preparation apparatus shown in FIG. 7 may be used in or with any of the embodiments of the invention as shown in the other figures.

In some embodiments, the feed mixture may be mixed using an in-line mixer(s) and/or produced in-situ within the FCIP reactor 714 by adding at least one of the feed oil, water and/or the finely divided solids directly into the FCIP reactor 714 and/or by the addition of water and/or addition of solids directly to the pyrolysis chamber, depending on the composition of the feed oil and the end use of the product LIP.

In some embodiments, the pyrolyzate vapor phase is condensable to form an oil phase lighter than the feed oil. In some embodiments the pressure in the FCIP reactor 714 is sufficiently low and the temperature sufficiently high such that the pyrolyzate exits the reactor in the vapor phase or primarily in the vapor phase, e.g. with at least 70 wt % of the recovered hydrocarbons, preferably at least 80 wt %, or at least 90 wt %, or at least 95 wt %, or at least 98 wt %, or at least 99 wt % or at least 99.9 wt %, or 100 wt % of the recovered hydrocarbon exit the reactor 146 in the vapor phase, based on the total weight of the recovered hydrocarbons. In general, the pyrolyzate effluent 148 is primarily or mostly gas phase, comprised of hydrocarbons, steam, and in the case of direct heating, flue gases such as carbon dioxide or monoxide, nitrogen, additional steam, etc., but may entrain relatively minor amounts of liquid droplets and/or small-particle solids (fines) that may be removed by filtration, cyclonic separation and/or condensation with the recovered hydrocarbons when they are subsequently condensed to produce the catalytic pyrolysis oil product.

In an embodiment, the absolute pressure in the reactor 714 is from about 1 to 1.5 atm absolute, e.g. from about 1 atm to about 1.5 atm, or to about 1.1 atm, and the pyrolyzate vapor 148 exits from the reactor at a temperature above 425° C., e.g., above 450° C., up to about 480° C., up to about 500° C., or up to about 600° C., e.g., 450° C.-500° C., 450° C.-480° C., or 500° C.-600° C.

The feed mixture from line 728 may be heated in the pyrolysis chamber by hot gas 730, e.g., combustion effluent or another gas at a temperature from about 300° C. or 600° C. up to about 1200° C., either in direct heat exchange relation via line 732 or indirect heat exchange relation via line 734. In practice only one arrangement is present in the apparatus 700, either direct or indirect heating. In embodiments the hot gas 730 comprises combustion gas from a fuel-rich combustion, e.g., comprising less than about 1 vol % molecular oxygen, or another effluent having a sufficiently low oxygen content to inhibit combustion in the reactor 714. In direct heating, the hot gas 730 may have a temperature from about 300° C. to about 1200° C., and is contacted or mixed directly with the feed mixture or reaction products thereof, and the hot gas exits the FCIP reactor 714 with the pyrolyzate in effluent stream 736. In indirect heating, the hot gas 730, preferably supplied at an inlet temperature from about 600° C. to about 1200° C., enters a heat exchanger 737 within the FCIP reactor 714 and cooled gas 738 is collected from an outlet of the heat exchanger. Solids 740 accumulating in the reactor 714 may be periodically or continuously removed for disposal or for recycling in the process (re-used as the finely divided solids and/or its preparation), with or without regeneration.

In embodiments, the effluent 736 with the product LIP exits the FCIP reactor 714 at a temperature greater than about 425° C., or greater than about 450° C. In embodiments, the effluent 736 exits the process vessel at a chamber exit 24 at a temperature of about 600° C. or below, or below about 500° C. The effluent 736 from the reactor 714 can be processed as desired, e.g., in separator 742 to remove entrained fines 744 and/or in separator 746 to recover water 748 and one or more oil fractions, e.g., LIP 750, and to exhaust non-condensable gases 752. The separator 740 can comprise a cyclone separator, a filter such as a baghouse, an electric precipitator, etc. Separator 746 can comprise condensers to recover condensate and gravity separation devices, e.g., a centrifuge or oil-water separator tank, to phase separate condensate comprising oil and water mixtures. Separator 746 can if desired optionally further include recovery of light hydrocarbons, e.g., hydrogen, methane, ethane, ethylene, propane, propylene, fuel gas, or the like, using a cryogenic process, membrane separators, and so on.

In embodiments, the FCIP reactor 714 comprises a turbulent environment, and may contain a bed of particulate inert solids (see FIG. 9), which may comprise silica, alumina, sand, or a combination thereof, and/or may include nonvolatile residues from previously treated mixtures such as ash, coke, and/or heavy hydrocarbons (i.e., having 40 carbons or more). These residues may collect and/or may be continuously or periodically removed from the FCIP reactor 714. In embodiments, the feed mixture in line 728 is fed to FCIP reactor 714 at a point below a bed, thus fluidizing the bed, and/or the feed mixture may enter just over the bed, e.g., downwardly directed such as onto the bed or on an impingement plate (fixed or partially fluidized bed) from which the more volatile compounds rise immediately and the less volatile compounds are converted to more volatile compounds in the bed.

In embodiments, the combustion gases utilized as the hot gas 730 in any of the processes disclosed herein, especially in the direct heating embodiments, are sub-stoichiometric with respect to oxygen (oxygen lean/fuel rich) such that the concentration of molecular oxygen $O_2$ in the reactor is less than about 1 vol %, or less than 0.1 vol %, or the combustion gas is essentially free of molecular oxygen. Accordingly, in embodiments, the pyrolysis reactor 714 comprises a reducing atmosphere.

Figure 8:
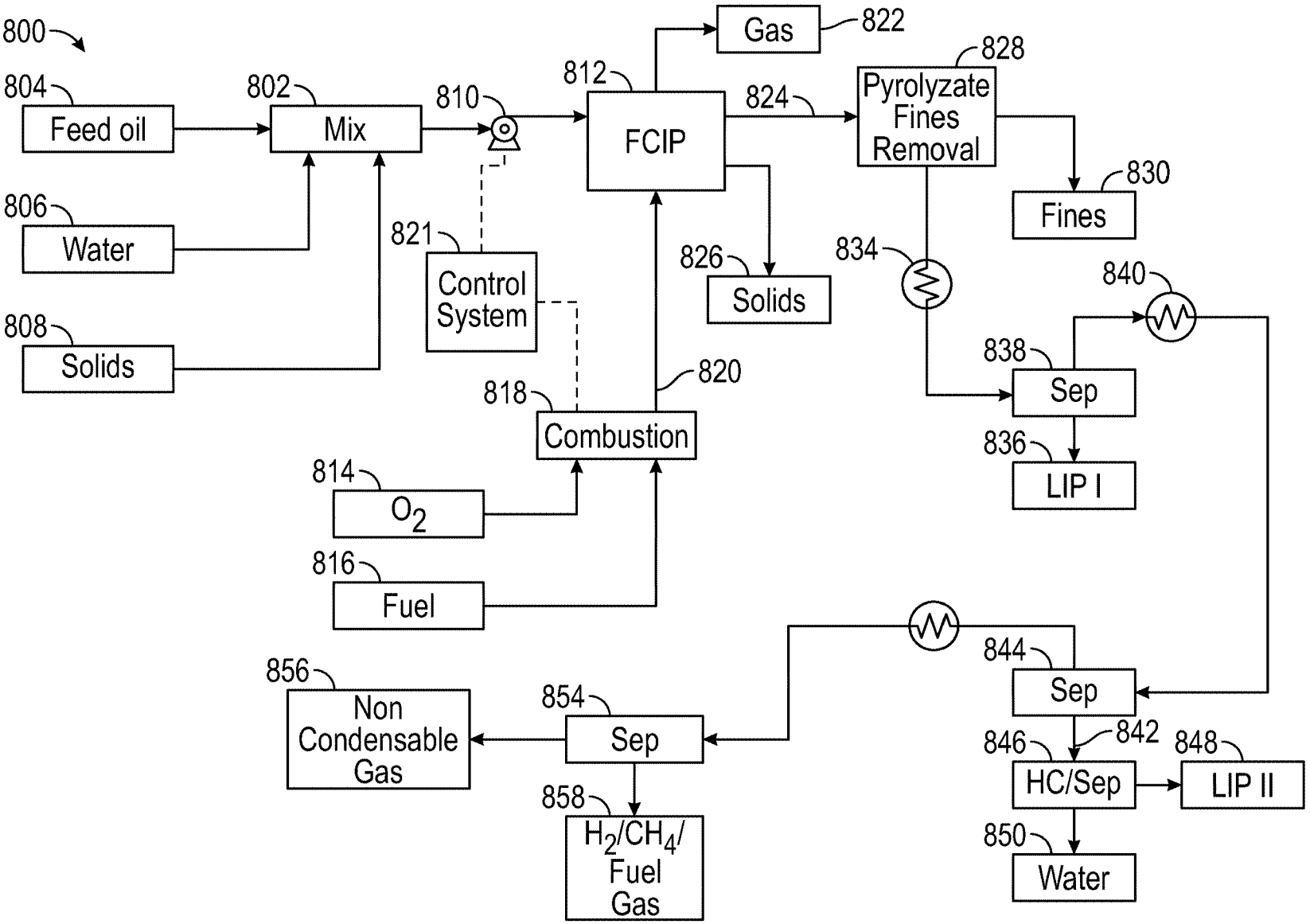
FIG. 8 shows a schematic flow diagram of another FCIP process for making the LIP, according to embodiments of the present invention.

With reference to FIG. 8, a process 800 according to some embodiments of the present invention comprises a mixer and/or mixing tank 802 to combine feed oil 804, water 806, and finely divided solids 808 into an emulsion as described herein (cf. discussion of FIG. 7). The emulsion is transferred via pump 810 to FCIP reactor 812. An oxygen source 814 such as air, oxygen or oxygen-enriched air is combined with fuel 816 in combustion burner 818 to supply combustion effluent in line 820 to the reactor 812, as described herein (cf. discussion of FIG. 7). Control system 821 is provided to control the operating conditions of the FCIP reactor 812, e.g., by manipulation or adjustment of the feed rate(s) and/or combustion rates to maintain the pyrolysis zone at a temperature, pressure and residence time to form an LIP vapor phase. In the case of indirect heating, cold gas 822 is recovered; otherwise the combustion gases are mixed with the steam and LIP vapors and recovered in effluent line 824. Solids 826 may be recovered from the reactor 812 continuously or periodically.

The effluent from line 824 is processed in fines removal unit 828, to separate fines 830, optionally including any liquid droplets or other solids, and the remaining vapor can optionally be supplied directly to an oil or heavy oil reservoir recovery process (see FIG. 11 of US 2016/0160131 A1), or after conditioning to remove any undesirable components, supplement any additional components needed, compress to injection pressure, heat to the desired injection temperature, and/or cool to recover waste heat.

The remaining vapor can be cooled in exchanger 834 and hydrocarbon condensate (LIP I) 836 recovered from separator 838. The process temperature in the exchanger 834 and separator 838 is preferably above the water dew point so that the condensate 836 is essentially free of water, e.g., less than 1 wt %. The vapors from separator 838 are then cooled in exchanger 840 and condensate 842 recovered from separator 844. The process temperature in the exchanger 840 and separator 844 is preferably below the water dew point so that the condensate 842 is a mixture of water and oil, which can be further separated in separator 846, which can be a centrifuge or gravity settling tank, for example, to obtain oil product (LIP II) 848 and water 850. The overhead vapor from the separator 844 can be exhausted and/or used as a fuel gas, or it can optionally be further processed in exchanger 852 for cooling and separated in separator 854 into non-condensable gases 856 and or product 858 comprised of one or more streams of hydrogen, methane, ethane, ethylene, propane, propylene, carbon dioxide, fuel gas, including combinations thereof. The separator 854 can be any one or suitable combination of a cryogenic separator, membrane separator, fractionator, solvent extraction, pressure swing absorption, or the like.

Figure 9:
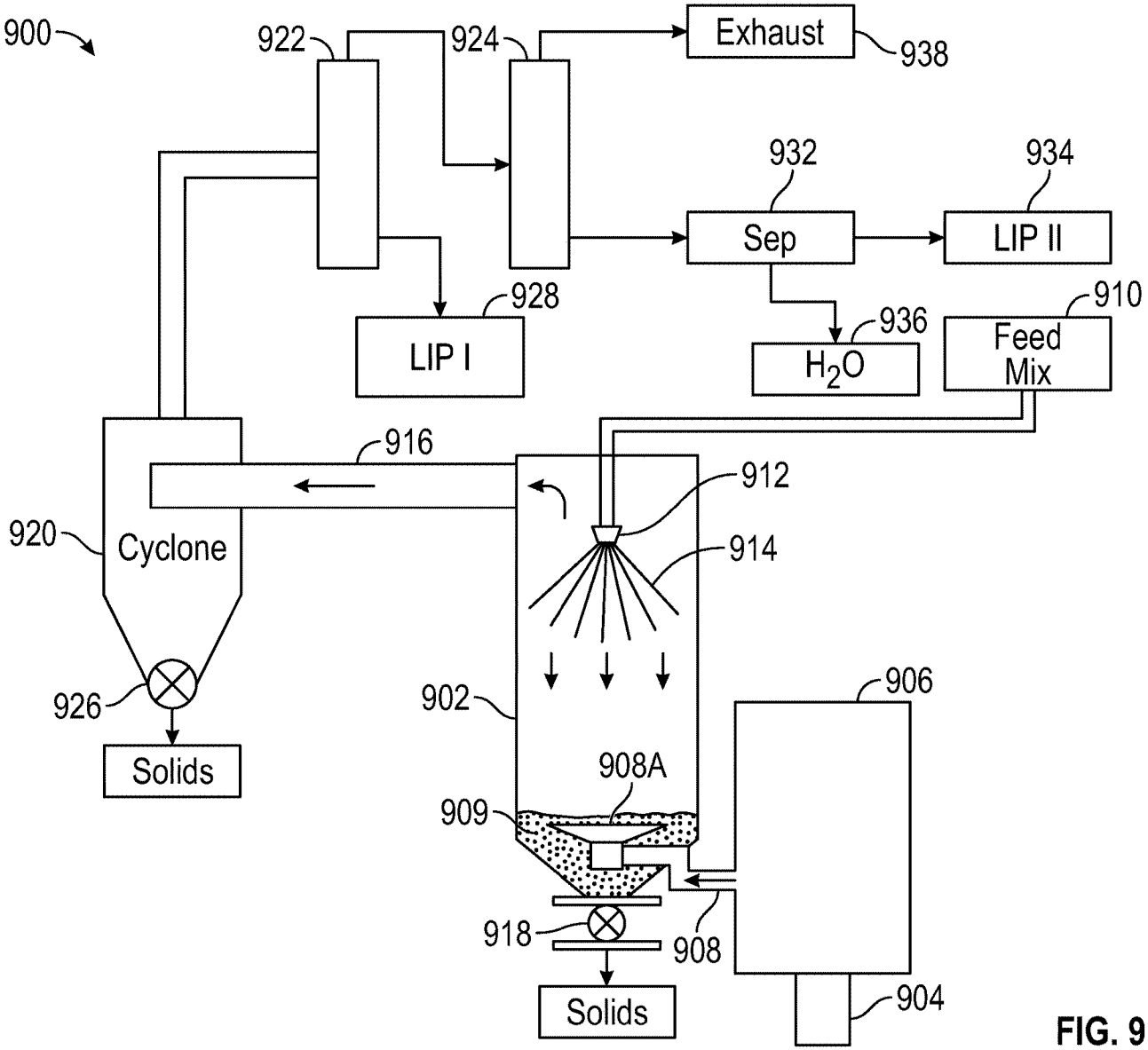
FIG. 9 shows a schematic flow diagram of a further FCIP process for making the LIP, according to embodiments of the present invention.

With reference to FIG. 9, a process 900 comprises a reactor 902 that is directly heated by combustion gases supplied from burner 904 in combustion chamber 906 through duct 908, which can direct the combustion effluent through distributor **908*a* located to fluidize the solids 909. Feed mixture 910 can be prepared, for example, as described above (cf. discussion of FIGS. 7-8). The feed mixture 910 is supplied to nozzle 912 and forms a preferably conical spray pattern 914 in the reactor 902**.

The nozzle 912 is directed downwardly and can be positioned near the upper end of the reactor, e.g., ⅓ of the way down from the top of the reactor toward the bottom. The nozzle 912 is preferably designed and positioned so that the spray pattern 914 avoids excessive impingement on the inside surfaces of the reactor 902 that can lead to caking and/or buildup of solids on the walls. For example, the nozzle 912 can provide a conical spray pattern. The feed mixture 910 is thus introduced countercurrently with respect to the flue gas from combustion chamber 906 to promote mixing and rapid heating to facilitate the conversion and volatilization of hydrocarbons.

The pyrolyzate vapor phase exits the reactor 902 together with the combustion gas and steam from the feed mixture water into duct 916. The upward flow rate of the gases in the reactor 902 in some embodiments is sufficiently low to avoid excessive entrainment of solid particulates. The solid particulates can thus fall to the bottom of the reactor 902 and can be periodically and/or continuously withdrawn, e.g., via rotary valve 918, for disposal and/or regeneration and recycle to the slurry preparation. Regeneration can be effected in some embodiments by contacting the solids with an oxygen containing gas at high temperature to promote combustion of hydrocarbon residue and coke from the particles. In any embodiment, regeneration can be in situ in reactor 902, e.g., by supplying oxidant gas into the solids bed 940 for combustion of coke.

The gases from the reactor 902 in some embodiments are passed into cyclone 920 for removal of fines. Fines can be periodically and/or continuously withdrawn from the cyclone 920, e.g., via rotary valve 926. The solids-lean gases in some embodiments are then passed through condensers 922 and 924. The first condenser 922 preferably condenses hydrocarbons, which have a relatively higher boiling point than water, at a temperature above the water dew point so that the oil 928 (LIP I) has a low water content, e.g., essentially free of water so that water separation is not needed. The second condenser 924 preferably condenses the hydrocarbons and water which may be processed, if desired, in separator 932 to separate an oil phase 934 (LIP II) from a water phase 936, e.g., by gravity settling, centrifuge, or the like. The recovered water in this and any of the other embodiments illustrated herein can, if desired, be recycled for preparation of the feed mixture to the FCIP reactor (cf. FIGS. 1, 4-8), the desalting 510 (FIG. 5), and so on. Non-condensed exhaust gases 938 are recovered overhead from the condenser 924.

EMBODIMENTS

The present invention provides, among others, the following preferred embodiments:

1. A hydrocarbon refinery process comprising the steps of:
   (a) combining a liquid ionizing pyrolyzate with crude oil to form an LIP-crude blend comprising the pyrolyzate in an amount from 10 to 20 wt % based on the total weight of the HP-crude blend;
   (b) combining a first portion of the LIP-crude blend, water, and 1-4 wt % of a finely divided solids to obtain an emulsion comprising (i) 75-85 wt % of an oil phase, (ii) 5-15 wt % of an aqueous phase, and (iii) 3-10 wt % total solids, based on the total weight of the emulsion, wherein the finely divided solids comprise the product of combining $FeCl_3$ of limited solubility and NaCl-treated bentonite and heat treating the combined $FeCl_3$ and bentonite at a temperature of 400° C. to 425° C.;
   (c) spraying the emulsion in a vapor phase of a flash chemical ionizing pyrolysis reactor at a temperature of 450-500° C.;
   (d) collecting an effluent from the pyrolysis reactor;
   (e) recovering a crude oil pyrolyzate from the effluent;
   (f) supplying the crude oil pyrolyzate from step (e) as the hydrocarbon pyrolyzate in step (a);
   (g) desalting a second portion of the LIP-crude blend from step (a);
   (h) supplying brine recovered from step (g) as the water in step (b);
   (i) preheating the desalted LIP-crude blend from step (g);
   (j) atmospherically distilling the preheated LIP-crude blend from step (i) to separate an atmospheric resid from lower boiling hydrocarbon fractions; and
   (k) vacuum distilling the atmospheric resid to separate a vacuum resid from gas oil.

2. A hydrocarbon refinery process comprising the steps of:
   (a) combining a liquid ionizing pyrolyzate with resid to form an LIP-resid blend comprising the pyrolyzate in an amount from 10 to 20 wt % based on the total weight of the LIP-resid blend;
   (b) combining a first portion of the LIP-resid blend, water, and 1-4 wt % of a finely divided solids, wherein the finely divided solids comprises the product of combining $FeCl_3$ of limited solubility and NaCl-treated bentonite and heat treating the combined $FeCl_3$ and bentonite at a temperature of 400° C. to 425° C., to obtain an emulsion comprising (i) 75-85 wt % of an oil phase, (ii) 5-15 wt % of an aqueous phase, and (iii) 3-10 wt % total solids, based on the total weight of the emulsion;
   (c) spraying the emulsion in a vapor phase of a flash chemical ionizing pyrolysis reactor at a temperature of 450-500° C.;
   (d) collecting an effluent from the pyrolysis reactor;
   (e) recovering a liquid ionizing pyrolyzate product from the effluent;
   (f) supplying the liquid ionizing pyrolyzate product from step (e) as the liquid ionizing pyrolyzate in step (a);
   (g) distilling a second portion of the LIP-resid blend from step (a) to separate resid from lower boiling hydrocarbon fractions;
   (h) supplying a first portion of the resid from step (g) to the LIP-resid blend in step (a); and
   (i) optionally coking a second portion of the resid from step (g) to obtain coker gas oil.

3. Finely divided solids for emulsion flash ionizing pyrolysis, comprising:
   (a) NaCl-treated calcium bentonite;
   (b) $FeCl_3$;
   (c) preferably wherein the finely divided solids are prepared according to the process comprising the steps of:
      i. treating iron particles with an equal weight of aqua regia, the aqua regia comprising 3 parts by weight hydrochloric acid, 2 parts by weight water, and 1 part by weight nitric acid, to form a solids mixture;
      ii. rinsing, drying, and grinding the solids mixture from (i);
      iii. treating calcium bentonite with 1 M NaCl brine;
      iv. rinsing, drying at 100-125° C., and grinding the treated bentonite from (iii);
      v. slurrying the solids mixture from (ii) in water to obtain a slurry comprising 4 wt % of the solids from (ii) by weight of the slurry;
      vi. combining 2 parts by weight of the slurry from (v) with 3 parts by weight of the treated bentonite from (iv) to form a paste; and
      vii. heat treating the paste from (vi) at a temperature of 400° C. to 425° C. for a period of 4-6 hours to obtain the solids; and
      viii. grinding the solids from (vii) to form the finely divided solids.

A1. A hydrocarbon conversion process, comprising the steps of:
   emulsifying water and an oil component with finely divided solids comprising a mineral support and an oxide and/or acid addition salt of a Group 3-16 metal (preferably $FeCl_3$ on an NaCl-treated clay);

introducing the emulsion into a flash chemical ionizing pyrolysis (FCIP) reactor maintained at a temperature greater than about 400° C. up to about 600° C. and a pressure up to about 1.5 atm to form an ionized pyrolyzate effluent;

condensing the ionized pyrolyzate from the effluent to recover a liquid ionized pyrolyzate (LIP);

combining a feedstock oil with the LIP to form a pyrolyzate-feedstock blend; and thermally processing the blend at a temperature above about 100° C.

A2. The process of embodiment A1, wherein the solids comprise brine-treated clay and an acid addition salt of a Group 8-10 metal, wherein the brine comprises a salt that forms a eutectic with the acid addition salt of the Group 8-10 metal.

A3. The process of embodiment A2, wherein the clay comprises bentonite, the brine comprises sodium chloride, and the acid addition salt comprises $FeCl_3$.

A4. The process of embodiment A3, comprising preparing the solids by a method comprising the steps of:

(a) contacting bentonite with the sodium chloride brine;

(b) contacting an excess of iron with an aqueous mixture of hydrochloric and nitric acids to form $FeCl_3$ solids;

(c) loading the $FeCl_3$ solids on the brine-treated bentonite; and (d) calcining the loaded bentonite at a temperature below the FCIP temperature.

A5. The process of any of embodiments A1 to A4, further comprising the steps of:

wherein the emulsion comprises (i) 100 parts by weight of the oil component, preferably wherein the oil component comprises the pyrolyzate-feedstock blend; (ii) from about 1 to 100 parts by weight of water, and (iii) from about 1 to 20 parts by weight of the finely divided solids; and spraying the emulsion into the reactor, wherein the reactor temperature is from about 425° C. to about 600° C., preferably 450° C. to 500° C.

A6. The process of embodiment A5 wherein the finely divided solids comprise the product of the method comprising the steps of:

treating iron with an aqueous mixture of hydrochloric and nitric acids to form a solids mixture of $FeCl_3$ optionally with mixed valences of iron and iron chlorides, nitrites, nitrites, oxides, and/or hydroxides, wherein the solids mixture has limited solubility;

treating montmorillonite with NaCl brine and drying the treated montmorillonite;

combining a slurry of the solids mixture with the treated montmorillonite to load the $FeCl_3$ on the montmorillonite; and heat treating the loaded montmorillonite at a temperature above 400° C.

A7. The process of any of embodiments A1 to A6, wherein the feedstock oil comprises hydrocarbons boiling at a temperature equal to or greater than 562° C., and further comprising the step of recovering a hydrocarbon product from the thermally processed blend, the hydrocarbon product having an enriched yield of liquid hydrocarbons boiling at a temperature below 562° C., relative to separate thermal processing of the LIP and feedstock oil, as determined by atmospheric distillation in a 15-theoretical plate column at a reflux ratio of 5:1, according to ASTM D2892-18 up to cutpoint 400° C. AET, and by vacuum potstill method according to ASTM D5236-18a above the 400° C. cutpoint to cutpoint 562° C. AET.

A8. The process of embodiment A7 wherein the feedstock oil is crude oil, gas oil, resid, or a mixture thereof.

A9. The process of any of embodiments A1 to A8 wherein the thermal processing comprises pyrolysis, distillation, cracking, alkylation, visbreaking, coking, and combinations thereof.

A10. The process of any of embodiments A1 to A9, further comprising supplying at least a portion of the pyrolyzate-feedstock blend as the oil component to the FCIP feed emulsion preparation step wherein the thermal processing step consists of or comprises the spraying of the FCIP feed emulsion into the flash pyrolysis reactor.

A11. A flash chemical ionizing pyrolysis (FCIP) process comprising the steps of:

preparing a feed emulsion comprising (i) 100 parts by weight of an oil component comprising a liquid ionizing pyrolyzate (LIP) and a feedstock oil at a weight ratio of from 1:100 to 1:1, (ii) from about 1 to 100 parts by weight of water, and (iii) from about 1 to 20 parts by weight finely divided solids comprising a mineral support and an oxide or acid addition salt of a Group 3-16 metal (preferably $FeCl_3$ on an NaCl-treated clay);

spraying the feed emulsion in a flash pyrolysis reactor at a temperature from about 425° C. to about 600° C.;

collecting an effluent from the reactor;

recovering a product oil from the effluent; and supplying a portion of the product oil as the LIP to the feed emulsion preparation step.

A12. A hydrocarbon refinery process comprising the steps of:

combining a liquid ionizing pyrolyzate (LIP) blend component with a feedstock oil at a weight ratio from about 1:100 to about 1:1 to form an LIP blend;

preparing an emulsion comprising (i) a first portion of the LIP blend, (ii) water, and (iii) from finely divided solids comprising a mineral support and an oxide or acid addition salt of a Group 3-16 metal (preferably $FeCl_3$ on an NaCl-treated clay);

spraying the emulsion in a flash pyrolysis reactor at a temperature from about 425° C. to about 600° C. and a pressure from about 1 to about 1.5 atm;

collecting an effluent from the reactor;

recovering a product LIP from the effluent;

incorporating the product LIP as the LIP blend component in the LIP blend; and distilling a second portion of the LIP blend.

A13. The process of embodiment A12, wherein the feedstock oil comprises crude oil.

A14. The process of embodiment A13, wherein the feedstock oil comprises un-desalted crude oil wherein the process further comprises water washing to desalt the second portion of the LIP blend, and distilling the desalted second portion of the LIP blend.

A15. The process of embodiment A9 wherein the feedstock oil comprises crude oil and further comprising washing the LIP blend with wash water, recovering a solute-enriched spent water from the water washing step, recovering a desalted LIP blend, and heating the desalted LIP blend in advance of distillation of the LIP blend.

A16. A hydrocarbon refinery process comprising the steps of:

preparing a feed emulsion comprising (i) 100 parts by weight of an oil component, (ii) from about 1 to 100 parts by weight of water, and (iii) from about 1 to 20 parts by weight finely divided solids comprising a mineral support and an oxide or acid addition salt of a Group 3-16 metal (preferably $FeCl_3$ on an NaCl-treated clay);

spraying the feed emulsion in a flash pyrolysis reactor at a temperature from about 425° C. to about 600° C.;

collecting an effluent from the flash pyrolysis reactor;

recovering a liquid ionizing pyrolyzate (LIP) from the effluent;

combining the recovered LIP with a feedstock oil comprising crude oil or a petroleum fraction selected from gas oil, resid, or a combination thereof to form a pyrolyzate-feedstock blend;

distilling, cracking, visbreaking, and/or coking a first portion of the LIP blend; and supplying a second portion of the LIP blend as the oil component in the feed emulsion preparation step.

A17. The process of embodiment A16, wherein the LIP exhibits a SARA analysis having higher saturates and aromatics contents and a lower asphaltenes content than the feedstock oil.

A18. The process of embodiment A16 or A17 wherein a proportion of the LIP in the oil component in the flash pyrolysis is effective to improve yield of liquid hydrocarbons boiling at a temperature below 562° C., relative to separate flash chemical ionizing pyrolysis of the LIP and feedstock oil, as determined by atmospheric distillation in a 15-theoretical plate column at a reflux ratio of 5:1, according to ASTM D2892-18 up to cutpoint 400° C. AET, and by vacuum potstill method according to ASTM D5236-18a above the 400° C. cutpoint to cutpoint 562° C. AET.

A19. The process of any of embodiments A16 to A18 wherein a proportion of the LIP in the LIP blend in the distillation, cracking, visbreaking, and/or coking step, is effective to improve yield of liquid hydrocarbons boiling at a temperature below 562° C., relative to separate distillation, cracking, visbreaking, and/or coking of the LIP and feedstock oil, as determined by atmospheric distillation in a 15-theoretical plate column at a reflux ratio of 5:1, according to ASTM D2892-18 up to cutpoint 400° C. AET, and by vacuum potstill method according to ASTM D5236-18a above the 400° C. cutpoint to cutpoint 562° C. AET.

A20. A crude oil upgrading process, comprising:

blending a liquid ionizing pyrolyzate (LIP) with a heavy oil; and thermally processing the blend at a temperature above about 100° C.

A21. The process of any of embodiments A1 to A19 wherein the oil component and/or the feedstock oil comprise crude oil.

A22. The process of any of embodiments A1 to A19 wherein the oil component and/or the feedstock oil comprise heavy crude oil.

A23. The process of any of embodiments A1 to A19 wherein the oil component and/or the feedstock oil comprise diesel.

A24. The process of any of embodiments A1 to A19 wherein the oil component and/or the feedstock oil comprise atmospheric resid.

A25. The process of any of embodiments A1 to A19 wherein the oil component and/or the feedstock oil comprise vacuum resid.

B1. A hydrocarbon conversion process, comprising the steps of:

combining a feedstock oil with a liquid ionizing pyrolyzate (LIP) to form an LIP blend; thermally processing the LIP blend; and recovering a hydrocarbon product having an enriched yield of liquid hydrocarbons boiling at a temperature below 562° C., relative to separate thermal processing of the LIP and feedstock oil, as determined by atmospheric distillation in a 15-theoretical plate column at a reflux ratio of 5:1, according to ASTM D2892-18 up to cutpoint 400° C. AET, and by vacuum potstill method according to ASTM D5236-18a above the 400° C. cutpoint to cutpoint 562° C. AET.

B2. The process of embodiment B1 wherein the feedstock oil is crude oil, gas oil, resid, or a mixture thereof.

B3. The process of embodiment B1 or embodiment B2 wherein the thermal processing comprises emulsion flash chemical ionizing pyrolysis (FCIP), distillation, cracking, alkylation, visbreaking, coking, and combinations thereof, preferably FCIP and/or distillation.

B4. The process of embodiment B3 wherein the liquid ionizing pyrolyzate (LIP) is produced from emulsion flash chemical ionizing pyrolysis (FCIP) comprising the steps of:

preparing an FCIP feed emulsion comprising (i) 100 parts by weight of an oil component, preferably wherein the oil component comprises the LIP blend; (ii) from about 5 to 100 parts by weight of a water component, and (iii) from about 1 to 20 parts by weight of finely divided additive comprising a mineral support and an oxide and/or acid addition salt of a Group 3-16 metal, preferably a Group 8-10 metal (preferably $FeCl_3$ on an NaCl-treated clay);

spraying the FICP feed emulsion in a pyrolysis reactor at a temperature from about 425° C. to about 600° C., preferably 450° C. to 500° C.;

collecting an effluent from the pyrolysis reactor; and recovering a product LIP from the effluent for use in the combining step to form the LIP blend.

B5. The process of embodiment B4 wherein the finely divided additive comprises $FeCl_3$ and montmorillonite, preferably wherein the finely divided additive comprises:

(i) $FeCl_3$ derived from the solids recovered from the treatment of iron with an aqueous mixture of hydrochloric and nitric acids, the $FeCl_3$ supported on a brine-treated montmorillonite, preferably NaCl brine-treated calcium bentonite, and/or (ii) the product of the method comprising the steps of:

treating iron with an aqueous mixture of hydrochloric and nitric acids to form a solids mixture of $FeCl_3$ optionally with mixed valences of iron and iron chlorides, nitrites, nitrites, oxides, and/or hydroxides, preferably wherein the solids mixture has limited solubility;

treating montmorillonite, preferably calcium bentonite, with brine, preferably NaCl brine;

combining a slurry of the solids mixture with the dried, treated montmorillonite to load the $FeCl_3$ on the montmorillonite; and heat treating the loaded montmorillonite at a temperature above 400° C., preferably 400° C. to 425° C.

B6. An emulsion flash chemical ionizing pyrolysis (FCIP) process comprising the steps of: preparing an FCIP feed emulsion comprising 100 parts by weight of an oil component, from about 5 to 100 parts by weight of a water component, and from about 1 to 20 parts by weight of finely divided additive comprising a mineral support and an oxide or acid addition salt of a Group 3-16 metal (preferably $FeCl_3$ on an NaCl-treated clay);

spraying the FICP feed emulsion in a flash pyrolysis reactor at a temperature from about 425° C. to about 600° C.;

collecting an effluent from the pyrolysis reactor;

recovering a product liquid ionizing pyrolyzate (LIP) from the effluent;

combining at least a portion of the product LIP with a feedstock oil to form an LIP blend comprising from 1 to 33.33 wt % of the product LIP; and thermally processing the LIP blend to form a hydrocarbon product having an enriched yield of liquid hydrocarbons boiling at a temperature below 562° C., relative to separate thermal processing of the LIP and feedstock oil, relative to separate thermal processing of the LIP and feedstock oil, as determined by atmospheric distillation in a 15-theoretical plate column at a reflux ratio of 5:1, according to ASTM D2892-18 up to cutpoint 400° C. AET, and by vacuum potstill method according to ASTM D5236-18a above the 400° C. cutpoint to cutpoint 562° C. AET.

B7. The process of embodiment B6, further comprising supplying at least a portion of the LIP blend as the oil component to the FCIP feed emulsion preparation step wherein the thermal processing step consists of or comprises the spraying of the FCIP feed emulsion into the flash pyrolysis reactor.

B8. An emulsion flash chemical ionizing pyrolysis (FCIP) process comprising the steps of:

preparing an FCIP feed emulsion comprising (i) 100 parts by weight of an oil component comprising a feedstock oil and from 1 to 33.33 wt % of a liquid hydrocarbon pyrolyzate (LIP), based on the total weight of the oil component, (ii) from about 5 to 100 parts by weight of a water component, and (iii) from about 1 to 20 parts by weight finely divided additive comprising a mineral support and an oxide or acid addition salt of a Group 3-16 metal;

spraying the FCIP feed emulsion in a pyrolysis reactor at a temperature from about 425° C. to about 600° C.;

collecting an effluent from the pyrolysis reactor;

recovering a product LIP from the effluent; and optionally supplying a portion of the product LIP to the feed emulsion preparation step.

B9. A hydrocarbon refinery process comprising the steps of:

combining a liquid ionizing pyrolyzate (LIP) with a feedstock oil to form an LIP blend comprising the LIP in an amount from 1 to 33.33 wt % based on the total weight of the LIP blend;

preparing an FCIP feed emulsion comprising (i) 100 parts by weight of a first portion of the LIP blend, (ii) from about 5 to 100 parts by weight of a water component, and (iii) from about 1 to 20 parts by weight finely divided additive comprising a mineral support and an oxide or acid addition salt of a Group 3-16 metal (preferably $FeCl_3$ on an NaCl-treated clay);

spraying the FCIP feed emulsion in an emulsion flash chemical ionizing pyrolysis reactor at a temperature from about 425° C. to about 600° C.;

collecting an effluent from the flash pyrolysis reactor;

recovering a product LIP from the effluent;

incorporating at least a portion of the product LIP into the LIP blend; and distilling a second portion of the LIP blend.

B10. The process of embodiment B9, wherein the feedstock oil comprises crude oil, preferably un-desalted crude oil wherein the process further comprises water washing to desalt the second portion of the LIP blend, and distilling the desalted second portion of the LIP blend.

B11. The process of embodiment B9 wherein the feedstock oil comprises crude oil and further comprising washing the LIP blend with wash water, recovering a solute-enriched spent water from the water washing step, recovering a desalted LIP blend, and heating the desalted LIP blend, preferably in advance of distillation of the LIP blend.

B12. A hydrocarbon refinery process comprising the steps of:

preparing a feed emulsion comprising (i) 100 parts by weight of an oil component, (ii) from about 5 to 100 parts by weight of a water component, and (iii) from about 1 to 20 parts by weight finely divided additive comprising a mineral support and an oxide or acid addition salt of a Group 3-16 metal (preferably $FeCl_3$ on an NaCl-treated clay);

spraying the feed emulsion in a flash pyrolysis reactor at a temperature from about 425° C. to about 600° C.;

collecting an effluent from the flash pyrolysis reactor;

recovering a liquid ionizing pyrolyzate (LIP) from the effluent;

combining the recovered LIP with a feedstock oil comprising a petroleum fraction selected from gas oil, resid, or a combination thereof to form an LIP blend; and distilling, cracking, visbreaking, and/or coking the LIP blend.

B13. The process of embodiment B12 wherein the oil component in the feed emulsion from the preparation step comprises the petroleum fraction, preferably the LIP blend from the combining step.

B14. The process of any of embodiments B6 to B13 wherein the pressure in the pyrolysis reactor is from about 1 to 3 atm, preferably 1 to 1.5 atm.

B15. The process of any of embodiments B6 to B13 wherein the LIP blend comprises the feedstock oil and a proportion of the LIP effective to improve conversion in the pyrolysis reactor of the oil component to the LIP at an enriched yield of liquid hydrocarbons boiling at a temperature below 562° C., and/or an enriched yield of distillates, relative to separate FCIP of the LIP and feedstock oil, relative to separate thermal processing of the LIP and feedstock oil, as determined by atmospheric distillation in a 15-theoretical plate column at a reflux ratio of 5:1, according to ASTM D2892-18 up to cutpoint 400° C. AET, and by vacuum potstill method according to ASTM D5236-18a above the 400° C. cutpoint to cutpoint 562° C. AET.

B16. The process of any of embodiments B6 to B13 wherein the LIP blend comprises the LIP in an amount from 1 to 33.33 percent and the feedstock oil in an amount from 99 to 66.67 percent, by weight of the LIP blend, preferably from 5 to 25 percent LIP and from 95 to 75 percent feedstock oil, more preferably from 10 to 20 percent LIP and from 90 to 80 percent feedstock oil.

B17. The process of any of embodiments B6 to B13 wherein the mineral support comprises montmorillonite, preferably bentonite, more preferably wherein the process comprises treating calcium bentonite with a sodium chloride brine and/or heat treating the bentonite, preferably to a temperature of 400° C. to 425° C.

B18. The process of embodiment B17 wherein the finely divided additive comprises $FeCl_3$ and NaCl-treated montmorillonite.

B19. The process of embodiment B17, wherein the finely divided additive comprises the reaction product of elemental iron with an aqueous mixture of hydrochloric acid and nitric acid, preferably wherein a molar ratio of the iron to the total hydrochloric and nitric acids is from 1:2 to 2:1, a molar ratio of the iron to water is from 1:2 to 2:1, and/or a molar ratio of hydrochloric acid to nitric acid is from 1:1 to 10:1, more preferably the reaction product of equal weights of the iron and aqua regia wherein the aqua regia comprises 3 parts by weight hydrochloric acid, 2 parts by weight water, and 1 part by weight nitric acid.

B20. The process of embodiment B19, wherein the finely divided additive comprises the reaction product of the iron and the aqueous hydrochloric and nitric acids loaded on NaCl-treated calcium bentonite and heat treated, preferably to 400° C. to 425° C.

B21. The process of any of embodiments B6 to B13, further comprising preparation of the finely divided additive according to a procedure comprising the steps of:

(a) reacting elemental iron with an aqueous mixture of hydrochloric acid and nitric acid, preferably wherein a molar ratio of the iron to the total hydrochloric and nitric acids is from 1:2 to 2:1, a molar ratio of the iron to water is from 1:2 to 2:1, and/or a molar ratio of hydrochloric acid to nitric acid is from 1:1 to 10:1, more preferably the reaction product of equal weights of the iron and aqua regia wherein the aqua regia comprises 3 parts by weight hydrochloric acid, 2 parts by weight water, and 1 part by weight nitric acid;

(b) treating calcium bentonite with NaCl brine;

(c) loading the reaction product from (a) on the treated bentonite from (b), preferably by incipient wetness, more preferably by drying the treated bentonite from (b), slurrying the reaction product from (a), and contacting the dried bentonite with the slurry;

(d) heat treating the bentonite loaded with the reaction product, preferably by heating to a temperature from 400° C. to 425° C.; and (e) grinding the heat treated sodium bentonite, preferably to a size passing a 60 mesh screen.

B22. The process of any of embodiments B1 to B21 wherein the oil component (if present) and/or the feedstock oil comprise crude oil.

B23. The process of any of embodiments B1 to B21 wherein the oil component (if present) and/or the feedstock oil comprise heavy crude oil.

B24. The process of any of embodiments B1 to B21 wherein the oil component (if present) and/or the feedstock oil comprise diesel.

B25. The process of any of embodiments B1 to B21 wherein the oil component (if present) and/or the feedstock oil comprise atmospheric resid.

B26. The process of any of embodiments B1 to B21 wherein the oil component (if present) and/or the feedstock oil comprise vacuum resid.

C1. A hydrocarbon desulfurization process, comprising the steps of:

emulsifying water and a high sulfur oil component comprising a feedstock oil with finely divided solids comprising a mineral support and an oxide and/or acid addition salt of a Group 3-16 metal (preferably $FeCl_3$ on an NaCl-treated clay);

introducing the emulsion into a flash chemical ionizing pyrolysis (FCIP) reactor maintained at a temperature greater than about 400° C. up to about 600° C. and a pressure up to about 1.5 atm to form an ionized pyrolyzate effluent;

condensing the ionized pyrolyzate from the effluent to recover a liquid ionized pyrolyzate (LIP) having a reduced sulfur content relative to the high sulfur oil component.

C2. The process of embodiment C1, wherein the solids comprise brine-treated clay and an acid addition salt of a Group 8-10 metal, wherein the brine comprises a salt that forms a eutectic with the acid addition salt of the Group 8-10 metal.

C3. The process of embodiment C2, wherein the clay comprises bentonite, the brine comprises sodium chloride, and the acid addition salt comprises $FeCl_3$.

C4. The process of embodiment C3, comprising preparing the solids by a method comprising the steps of:

(a) contacting bentonite with the sodium chloride brine;

(b) contacting an excess of iron with an aqueous mixture of hydrochloric and nitric acids to form $FeCl_3$ solids;

(c) loading the $FeCl_3$ solids on the brine-treated bentonite; and (d) calcining the loaded bentonite at a temperature below the FCIP temperature.

C5. The process of any of embodiments C1 to C4, further comprising:

wherein the emulsion comprises (i) 100 parts by weight of the oil component, preferably wherein the oil component comprises the pyrolyzate-feedstock blend; (ii) from about 1 to 100 parts by weight of water, and (iii) from about 1 to 20 parts by weight of the finely divided solids; and spraying the emulsion into the reactor, wherein the reactor temperature is from about 425° C. to about 600° C., preferably 450° C. to 550° C.

C6. The process of embodiment C5 wherein the finely divided solids comprise the product of the method comprising the steps of:

treating iron with an aqueous mixture of hydrochloric and nitric acids to form a solids mixture of $FeCl_3$ optionally with mixed valences of iron and iron chlorides, nitrites, nitrites, oxides, and/or hydroxides, wherein the solids mixture has limited solubility;

treating montmorillonite with NaCl brine and drying the treated montmorillonite;

combining a slurry of the solids mixture with the treated montmorillonite to load the $FeCl_3$ on the montmorillonite; and heat treating the loaded montmorillonite at a temperature above 400° C.

C7. The process of any of embodiments C1 to C6, further comprising combining the feedstock oil with the LIP from the condensation step to form the oil component for the emulsifying step (preferably at weight ratio of 5-35 wt % LIP and 95-65 wt % feedstock oil).

C8. The process of embodiment C1, further comprising:

combining the feedstock oil with the LIP from the condensation step to form a pyrolyzate-feedstock blend; and thermally processing the blend at a temperature above about 100° C.

C9. The process of embodiment C8, wherein the feedstock oil comprises hydrocarbons boiling at a temperature equal to or greater than 562° C., and further comprising the step of recovering a hydrocarbon product from the thermally processed blend, the hydrocarbon product having an enriched yield of liquid hydrocarbons boiling at a temperature below 562° C., relative to separate thermal processing of the LIP and feedstock oil, as determined by atmospheric distillation in a 15-theoretical plate column at a reflux ratio of 5:1, according to ASTM D2892-18 up to cutpoint 400° C. AET, and by vacuum potstill method according to ASTM D5236-18a above the 400° C. cutpoint to cutpoint 562° C. AET.

C10. The process of embodiment C9 wherein the feedstock oil is crude oil, gas oil, resid, or a mixture thereof.

C11. The process of any of embodiments C8 to C10 wherein the thermal processing comprises pyrolysis, distillation, cracking, alkylation, visbreaking, coking, and combinations thereof.

C12. The process of any of embodiments C8 to C11, further comprising supplying at least a portion of the pyrolyzate-feedstock blend as the oil component to the FCIP feed emulsion preparation step wherein the thermal processing step consists of or comprises the spraying of the FCIP feed emulsion into the flash pyrolysis reactor.

C13. A flash chemical ionizing pyrolysis (FCIP) process comprising the steps of:

preparing a feed emulsion comprising (i) 100 parts by weight of an oil component comprising a liquid ionizing pyrolyzate (LIP) and a high sulfur feedstock oil at a weight ratio of from 1:100 to 1:1, (ii) from about 1 to 100 parts by weight of water, and (iii) from about 1 to 20 parts by weight finely divided solids comprising a mineral support and an oxide or acid addition salt of a Group 3-16 metal (preferably $FeCl_3$ on an NaCl-treated clay);

spraying the feed emulsion in a flash pyrolysis reactor at a temperature from about 425° C. to about 600° C.;

collecting an effluent from the reactor;

recovering a product oil from the effluent, wherein the product oil has a sulfur content lower than sulfur content of the oil component; and supplying a portion of the product oil as the LIP to the feed emulsion preparation step.

C14. A hydrocarbon refinery process comprising the steps of:

combining a liquid ionizing pyrolyzate (LIP) blend component with a high sulfur feedstock oil at a weight ratio from about 1:100 to about 1:1 to form an LIP blend;

preparing an emulsion comprising (i) a first portion of the LIP blend, (ii) water, and (iii) from finely divided solids comprising a mineral support and an oxide or acid addition salt of a Group 3-16 metal (preferably $FeCl_3$ on an NaCl-treated clay);

spraying the emulsion in a flash pyrolysis reactor at a temperature from about 425° C. to about 600° C. and a pressure from about 1 to about 1.5 atm;

collecting an effluent from the reactor;

recovering a product LIP from the effluent;

incorporating the product LIP as the LIP blend component in the LIP blend; and distilling a second portion of the LIP blend.

C15. The process of embodiment C14, wherein the feedstock oil comprises crude oil.

C16. The process of embodiment C15, wherein the feedstock oil comprises un-desalted crude oil wherein the process further comprises water washing to desalt the second portion of the LIP blend, and distilling the desalted second portion of the LIP blend.

C17. The process of embodiment C11 wherein the feedstock oil comprises high sulfur crude oil and further comprising washing the LIP blend with wash water, recovering a solute-enriched spent water from the water washing step, recovering a desalted LIP blend, and heating the desalted LIP blend in advance of distillation of the LIP blend.

C18. A hydrocarbon refinery process comprising the steps of:

preparing a feed emulsion comprising (i) 100 parts by weight of an oil component, (ii) from about 1 to 100 parts by weight of water, and (iii) from about 1 to 20 parts by weight finely divided solids comprising a mineral support and an oxide or acid addition salt of a Group 3-16 metal (preferably $FeCl_3$ on an NaCl-treated clay);

spraying the feed emulsion in a flash pyrolysis reactor at a temperature from about 425° C. to about 600° C.;

collecting an effluent from the flash pyrolysis reactor;

recovering a liquid ionizing pyrolyzate (LIP) from the effluent;

combining the recovered LIP with a high sulfur feedstock oil comprising crude oil or a petroleum fraction selected from gas oil, resid, or a combination thereof to form a pyrolyzate-feedstock blend;

distilling, cracking, visbreaking, and/or coking a first portion of the LIP blend; and supplying a second portion of the LIP blend as the oil component in the feed emulsion preparation step.

C19. The process of embodiment C18, wherein the LIP exhibits a SARA analysis having higher saturates and aromatics contents and a lower asphaltenes content than the feedstock oil.

C20. The process of embodiment C18 or C19 wherein a proportion of the LIP in the oil component in the flash pyrolysis is effective to improve yield of liquid hydrocarbons boiling at a temperature below 562° C., relative to separate flash chemical ionizing pyrolysis of the LIP and feedstock oil, as determined by atmospheric distillation in a 15-theoretical plate column at a reflux ratio of 5:1, according to ASTM D2892-18 up to cutpoint 400° C. AET, and by vacuum potstill method according to ASTM D5236-18a above the 400° C. cutpoint to cutpoint 562° C. AET.

C21. The process of any of embodiments C18 to C20 wherein a proportion of the LIP in the LIP blend in the distillation, cracking, visbreaking, and/or coking step, is effective to improve yield of liquid hydrocarbons boiling at a temperature below 562° C., relative to separate distillation, cracking, visbreaking, and/or coking of the LIP and feedstock oil, as determined by atmospheric distillation in a 15-theoretical plate column at a reflux ratio of 5:1, according to ASTM D2892-18 up to cutpoint 400° C. AET, and by vacuum potstill method according to ASTM D5236-18a above the 400° C. cutpoint to cutpoint 562° C. AET.

EXAMPLES

Example 1A: Preparation of Supported Iron Solids

Preferred finely divided solids according to the present invention were prepared by loading oxidized Fe material containing $FeCl_3$ on NaCl-treated calcium bentonite generally using the process 300 of FIG. 3. The Fe was prepared by mixing with constant stirring 1 part by weight 100 mesh carbon steel shavings with 1 part by weight aqua regia (1 part by weight nitric acid, 3 parts by weight hydrochloric acid, 2 parts by weight water). The aqua regia was added in three aliquots (1 part each, i.e., ⅓, ⅓, ⅓), and the temperature increased to 95° C. The material dried considerably, leaving wet solids. The oxidized iron solids were washed with water, filtered, dried in an oven at 100° C., and ground to pass a 100 mesh screen. The oxidized iron solids had a black or dark violet color indicative of $FeCl_3$.

The oxidized iron solids were analyzed by wet chemistry by sequential digestion in hot water, followed by digestion of the water-insoluble solids in 20 wt % HCl(aq), and recovery of the insoluble material which was not further analyzed. Initially, a 5 g sample of the oxidized iron solids was placed in 150 ml of 100° C. water, and the water-insoluble solids remaining were recovered and weighed. The amount digested in the water was surprisingly only 1.4488 g, or 28.98 wt %. The filtrate was diluted to 1 L and the solute was found by spectrophotometry to contain 11.32 wt % total Fe consisting of 3.24 wt % Fe(II) and 8.08 wt % Fe(III), 32.79 wt % chloride, 3.52 wt % nitrite, and 1.17 wt % nitrate. The water-soluble fraction was thus determined to be mostly chloride and nitrite salts with some nitrate salts.

The water-insoluble fraction was then digested in 150 ml of 20% HCl in water, and 3.478 g went into solution, or 69.56 wt % of the initial oxidized iron sample. The acid soluble fraction was found to contain 62.23 wt % total Fe consisting of 7.04 wt % Fe(II) and 55.19. Fe(III), 51.18 wt % nitrate, and 0.2587 wt % nitrite. The acid soluble fraction was thus found to contain mostly ferric oxides and/or nitrates, with some ferrous iron and a small amount of nitrite. From a relatively small proportion of ferrous iron seen in the acid soluble fraction, it was inferred that little or no elemental iron was present. The acid insoluble fraction was just 1.46 wt % of the original sample, and appeared from its red color to be Fe(III) oxide, hematite. The wet chemistry data are summarized in the following Table 1:

TABLE 1

WET CHEMISTRY ANALYSIS OF IRON OXIDIZED BY AQUA REGIA

| Sample | Mass, g | Total Iron, wt % | Fe(II), wt % | Fe(III), wt % | Chloride, wt % | Nitrate ($NO_3^-$), % | Nitrite ($NO_2^-$), % |
|---|---|---|---|---|---|---|---|
| Original Sample | 5 | | | | | | |
| Water Solubles | 1.449 | 11.32 | 3.24 | 8.08 | 32.79 | 1.17 | 3.52 |
| Acid Solubles | 3.478 | 62.23 | 7.04 | 55.19 | nd | 51.18 | 0.2587 |
| Acid Insolubles | 0.073 | nd | nd | nd | nd | nd | nd |

nd = not determined

A 100 mesh calcium bentonite was obtained commercially. A 1 M aqueous NaCl brine was prepared from distilled water and salt obtained commercially. The bentonite was prepared by mixing the as-received bentonite with the brine at a 1:2 weight ratio (1 part by weight bentonite, 2 parts by weight brine), stirring for 1 hour, and then allowing the mixture to sit for 16-24 hours. The excess brine was removed, the NaCl-treated bentonite dried at 120-130° C. for 4-6 hours, and the dried material ground to pass through an 80 mesh screen. The dried NaCl-bentonite had a reddish-brown to dark violet color.

The 100 mesh oxidized iron was slurried at 1 part by weight oxidized iron in 24 parts by weight distilled water (4 wt % oxidized iron). Then 2 parts by weight of the slurry were mixed with 3 parts by weight of the dried 80 mesh bentonite, the resulting paste dried at 400° C. for 2 hours in an oven, and the solids cooled and ground to pass a 60 mesh screen. This oxidized Fe-bentonite, or one prepared in a similar manner, was used in the following examples.

Example 1B: Preparation of Supported Iron Solids

The finely divided solids were prepared as in Example 1A except 1 part by weight 100 mesh carbon steel shavings was mixed with 1 part by weight aqua regia comprising 1 parts by weight nitric acid, 6 parts by weight hydrochloric acid, and 2 parts by weight water, and/or the bentonite was treated with 2 molar NaCl brine and was not rinsed with water prior to drying.

Example 2: Steady State Flash Chemical Ionizing Pyrolysis Tests

These flash chemical ionizing pyrolysis (FCIP) tests used a pilot plant scale reactor similar to the direct-heating design shown in FIG. 9, except that only one exchanger downstream from the cyclone was used and there were no solids discharged from the reactor. Instead, a bed of sand was placed in the bottom of the reactor and some solids accumulated on the sand during the test. The reactor was heated by combustion flue gas flowing into the side of the reactor near the bottom. A slurry injection nozzle pointed downwardly (countercurrent to the flue gases) was positioned ⅓ of the way from the top of the reactor toward the bottom to provide a conical spray pattern. The reactor was equipped with thermocouples in the combustion chamber, within the reactor, at the top of the reactor, and in the cyclone.

An emulsion of heavy crude (API <10°) was prepared by heating the crude oil to 70° C., adding water and mixing with an overhead mixer for 10 minutes, then adding the finely divided solids, $FeCl_3$ on NaCl-treated bentonite prepared in a manner similar to Example 1A, and mixing for another 5 minutes. The resulting emulsion was composed of 5 parts by weight finely divided solids, 30 parts by weight water (added water plus water in heavy oil sample), and 65 parts by weight oil (heavy oil less water and solids).

The reactor was heated up to operating temperature with combustion gases only before the slurry feed was started. The reactor was then brought to steady state over 1-2 hours at a reactor temperature generally between 400° C. and 600°

C., the reactor outlet temperature generally between 300° C. and 400° C., and the cyclone temperature between 200° C. and 300° C. while maintaining the combustion at a steady rate between 1100° C. and 1200° C., adjusting the emulsion feed rate as necessary to obtain the desired temperatures, and collecting the pyrolyzate liquids from the condenser. The recovered liquid ionizing pyrolyzate (LIP) was a low viscosity, low-density (° API >30) liquid representing a recovery of 90 wt % of the oil from the slurry, while non-condensable gases represented just 4 wt % of the oil in the slurry.

Example 3: Flash Chemical Ionizing Pyrolysis with Maya Crude Oil-LIP Blends

In this example, flash chemical ionizing pyrolysis (FCIP) was conducted by the following procedure. The finely divided solids were the $FeCl_3$ on NaCl-treated bentonite prepared in a manner similar to Example 1A and/or 1B. The emulsion was prepared with a commercial blender, placed in a tank heated at 90° C., pressurized at 2-8 kg/cm$^2$ with inert gas, and fed to a nozzle with a conical spray pattern in a reactor measuring 8 in. diameter by 16 in. long. The reactor was heated using a gas burner, and a sand bed was placed in the reactor at the beginning of the test. The effluent was passed through a water-cooled condenser and the condensate was collected and separated into oil, water, and solids.

A 22° API Maya crude oil was used. The crude had a composition by retort distillation of 71 wt % oil (0-520° C.), 28 wt % heavy hydrocarbons (>520 to 800° C.), and 1 wt % inorganic solids. The physical properties and distillation fractions are described below in Table 2.

First, in Run 3-1, an emulsion was prepared as a baseline using 100% crude, and subjected to FCIP at 470° C. The FCIP product mix obtained a gas yield of 14%, an oil ("LIP-M1") yield of 69% (retort distillation <550-600° C.), a resid yield of 11% (>600° C.), and coke yield of 6%, expressed as percentages of the oil in the FCIP emulsion.

Then an emulsion was prepared in Run 3-2 as an example according to the present invention, using 90% of the crude and 10% of the LIP-M1 from the crude FCIP in Run 3-1, subjected to FCIP at 430° C. The yields were gas 7%, oil ("LIP-B1") 89%, and coke 4%, expressed as percentages of the oil in the FCIP emulsion. These represent yield increases in the oil and decreases in the resid, gas and coke, all to a greater extent than theoretical.

Then another emulsion was prepared for Run 3-3 as another example according to the present invention, again using 90% of the crude and 10% of the LIP-M1 from the crude FCIP in Run 3-1, subjected to FCIP at 470° C., and the yields were gas 3%, oil ("LIP-B2") 93%, and coke 4%, expressed as percentages of the oil in the FCIP emulsion. These likewise represent yield increases in the oil and decreases in the resid, gas and coke, all greater than theoretical relative to LIP-M1. The crude oil, emulsions, and FCIP products had the characteristics shown in Tables 2-3.

TABLE 2

MAYA CRUDE, BLENDS, AND FCIP CHARACTERIZATION

| Property | Unit | Maya Crude | Run 3-1 | Run 3-2 | Run 3-3 |
|---|---|---|---|---|---|
| FLASH CHEMICAL IONIZING PYROLYSIS Emulsion Feed Composition | | | | | |
| Oil (<600° C.) | wt % | N/A | 57.50 | 51.38 | 51.38 |
| Heavy HC | wt % | N/A | 22.68 | 20.26 | 20.26 |
| LIP-M | wt % | N/A | — | 9.04 | 9.04 |

TABLE 2-continued

MAYA CRUDE, BLENDS, AND FCIP CHARACTERIZATION

| Property | Unit | Maya Crude | Run 3-1 | Run 3-2 | Run 3-3 |
|---|---|---|---|---|---|
| Water | wt % | N/A | 15.00 | 15.01 | 15.01 |
| Finely divided solids | wt % | N/A | 4.01 | 3.58 | 3.58 |
| Other solids | wt % | N/A | 0.81 | 0.73 | 0.73 |
| Reactor Temperature | ° C. | N/A | 470 | 430 | 470 |
| PRODUCT (LIP) YIELDS | | | | | |
| Oil (<600° C.) | wt % | N/A | 80.38 | 89.3 | 93.17 |
| Gas | wt % | N/A | 13.57 | 6.63 | 3.05 |
| Coke | wt % | N/A | 6.05 | 4.07 | 3.78 |
| OIL PHYSICAL PROPERTIES | | | | | |
| Designation | | Crude | LIP-M1 | LIP-B1 | LIP-B2 |
| °API | °API | 22 | 35.60 | 35.60 | 35.60 |
| Density | g/cm$^3$ | 0.92 | 0.847 | 0.847 | 0.847 |
| Viscosity @40° C. | cP | 459.20 | 13.30 | 14.43 | 11.76 |
| Viscosity@100° C. | cP | 58.68 | 11.85 | 7.05 | 6.45 |
| Flash Point | ° C. | 133 | 33.4 | 31.0 | 36.0 |
| Initial Boiling Point | ° C. | 155 | 100 | 108 | 145 |
| Conradson carbon | % CC | 11.96 | 1 | 1 | 1 |

It is considered that if the yields of FCIP of oil LIP-M1 alone is assumed to be 100%, then the theoretical oil LIP-B1/LIP-B2 yields from FCIP of the 90:10 blend of Maya crude and LIP-M1 would be (0.9*80.3)+(0.1*100)= 82.3 wt %. However, the resulting yields of 89.3 wt % of LIP-B1 for FCIP at 430° C., and 93.17 of LIP-B2 for FCIP at 470° C. (see Table 2), demonstrated an unexpected synergy in FCIP thermal processing of the blends of Maya crude and LIP-M1. Moreover, the improved quality of the LIP-B1 and LIP-B2, namely an increased level of isomerates, was demonstrated by the lower viscosities at 100° C. and/or 40° C. and higher initial boiling points, relative to the LIP-M1 product.

TABLE 3

MAYA CRUDE DISTILLATES CHARACTERIZATION

| PROPERTY | FRACTION F-1 | F-2 | F-3 | F-4 | F-5 |
|---|---|---|---|---|---|
| Recovery, Weight % | 13.2 | 11.1 | 18.4 | 25.9 | 0 |
| Distillation Temp. (° C.) | <330 | 331-344 | 345-423 | 423-428 | 453-528 |
| ° API | 52 | 39 | 35 | 31 | X |
| Density (g/cm$^3$) | 0.77 | 0.83 | 0.85 | 0.87 | X |
| Viscosity @ 50° C. (cP) | nd | nd | 9.63 | 10.35 | X |
| Aniline Point (° C.) | 61 | 65 | 63 | 57 | X |
| Flash Point (° C.) | 32 | 81 | 32 | 35 | X |
| Initial Boiling Point (° C.) | 120 | 145 | 67 | 164 | X |

X = no product;
nd = not determined

Example 4: Flash Chemical Ionizing Pyrolysis of Maya Crude

In Run 4, an 8° API Maya crude oil was subjected to FCIP to produce an LIP (LIP-B3) in a manner similar to LIP-B2 in Run 3-3. SARA analyses of the crude and LIP showed the results in Table 4 below. The LIP unexpectedly had more than twice the saturates, and more than three times the aromatics, slightly less resins, and substantially lower asphaltenes, relative to the crude starting material. This shows that primarily the asphaltenes were converted to saturates and aromatics.

TABLE 4

SARA ANALYSES OF 8°API CRUDE AND LIP FROM FCIP

| Component | 8°API Crude | LIP-B3 |
|---|---|---|
| Saturates, wt | 4 | 10 |
| Aromatics, wt % | 12 | 40 |
| Resins, wt % | 37 | 36 |
| Asphaltenes, wt % | 47 | 14 |

Example 5: Desulfurization of Maya Crude Oil-LIP Blends in Flash Chemical Ionizing Pyrolysis In this example, Maya crude (Run 5-1) and a mixture (Run 5-2) of 85 wt % Maya crude and 15 wt % liquid ionizing pyrolyzate (an LIP-M from FCIP of the Maya crude) were subjected to FCIP in a manner similar to Examples 3 and 4, to study sulfur removal. In FCIP, sulfur can be removed by reduction of organic sulfur compounds by reactive hydrogen radicals to produce $H_2S$, and/or by oxidation of organic sulfur compounds by reaction with HOCl to form $SO_x$ compounds. As determined by ASTM D4294, the Maya crude had an initial sulfur content of 4.4 wt %. When the Maya crude by itself was subjected to FCIP in Run 5-1, the resulting LIP-M2 had an ASTM D4294 sulfur content of 2.7 wt %. However, when the 85:15 blend of Maya crude and LIP-M2 was subjected to FCIP under similar conditions in Run 5-2, the resulting LIP-B4 had an ASTM D4294 sulfur content of 1.5 wt %, demonstrating synergy in sulfur removal when the blend was thermally processed by FCIP. The results are listed in Table 5.

Example 6: Desulfurization of Texistepec Crude Oil-LIP Blends in Flash Chemical Ionizing Pyrolysis In this example, Texistepec crude (Run 6-1) and a mixture (Run 6-2) of 85 wt % Texistepec crude and 15 wt % liquid ionizing pyrolyzate (an "LIP-T" from FCIP of the Texistepec crude) were subjected to FCIP in a manner similar to Example 5, to study sulfur removal. In FCIP, sulfur can be removed by reduction of organic sulfur compounds by reactive hydrogen radicals to produce $H_2S$, and/or by oxidation of organic sulfur compounds by reaction with HOCl to form $SO_x$ compounds. As determined by ASTM D4294, the Texistepec crude had an initial sulfur content of 9.7 wt %. When the Texistepec crude by itself was subjected to FCIP in Run 6-1, the resulting LIP-T1 had an ASTM D4294 sulfur content of 6.6 wt %. However, when the 85:15 blend of Texistepec crude and LIP-T1 was subjected to FCIP under similar conditions in Run 6-2, the resulting LIP-B5 had an ASTM D4294 sulfur content of 5.4 wt %, again demonstrating synergy in sulfur removal when the blend was thermally processed by FCIP. The results are also listed in Table 5.

TABLE 5

FCIP Desulfurization of Crude and Crude-LIP Blends

| FCIP Run | Crude, wt % | LIP, wt % | FCIP Product Designation | ASTM D4294 S content, wt % |
|---|---|---|---|---|
| N/A | Maya, 100 | — | N/A | 4.4 |
| 5-1 | Maya, 100 | — | LIP-M2 | 2.7 |
| 5-2 | Maya, 85 | LIP-M2, 15 | LIP-B4 | 1.5 |
| N/A | Texistepec, 100 | — | N/A | 9.7 |
| 6-1 | Texistepec, 100 | — | LIP-T1 | 6.6 |
| 6-2 | Texistepec, 85 | LIP-T1, 15 | LIP-B5 | 5.4 |

Example 7: Distillation of Maya Crude Oil-LIP Blends

In this example, distillation of 100% Maya crude (22-23° API) was compared with distillation in an identical manner of blends of the Maya crude with 10, 20, and 30 wt % of a liquid ionizing pyrolyzate (LIP-M3) obtained by the flash chemical ionizing pyrolysis (FCIP) of the Maya crude in a manner similar to Example 3. The distillation comprised or was similar to atmospheric distillation in a 15-theoretical plate column at a reflux ratio of 5:1, according to ASTM D2892-18 up to cutpoint 400° C. AET, and by vacuum potstill method according to ASTM D5236-18a above the 400° C. cutpoint to cutpoint 562° C. AET. Table 5 below lists the distillate yields and Conradson carbon residue (CCR) of the distillates from atmospheric and vacuum distillation. These data show that not only were the liquid yields synergistically higher for the crude-LIP blends, the quality of the distillates was unexpectedly improved, as reflected in the substantially lower CCRs of the distillates from the blends.

TABLE 6

DISTILLATE YIELDS AND CCR'S OF CRUDE, LIP, AND BLENDS

| FCIP Run | Maya Crude, wt % | LIP-M3, wt % | Distillation Yield, wt % | Conradson Carbon Residue, wt % |
|---|---|---|---|---|
| 7-1 | 100 | — | 60 | 12 |
| 7-2 | 80 | 20 | 68 | 7.6 |
| 7-3 | 70 | 30 | 74 | 5 |
| 7-4 | — | 100 | 89 | 4 |

The characteristics of the selected fractions of distillation of the Maya crude by itself are similar to those presented in Example 3 and Table 3. The data obtained for characteristics of selected fractions of the distillation of the 90:10 and 80:20 Maya crude:LIP blends are shown in Tables 7 and 8 below. These data show that blending a liquid ionizing pyrolyzate with a crude oil can synergistically increase distillation oil yield and reduce coke and gas yields in excess of theoretical, even assuming the LIP blend component converts 100% to oil and 0% to gas and coke. Moreover, the quality of the recovered oil is also improved, for example, no F-5 fraction was obtained from the Maya crude distilled by itself, but was recovered in both the 10 and 20% LIP blends. The density of each of the fractions F-1 to F-5 in the blends is the same or lower than the Maya crude distillation, e.g., F-1 fraction was lighter as reflected in the degrees API in the 10% LIP distillation, while F-1, F-2, and F-3 in the 20% LIP distillation were lighter (higher API gravity).

TABLE 7

90% MAYA:10% LIP DISTILLATES CHARACTERIZATION

| PROPERTY | F-1 | F-2 | F-3 | F-4 | F-5 |
|---|---|---|---|---|---|
| Recovery, Weight % | 22.5 | 11.3 | 8.0 | 17.9 | 14.1 |
| Distillation Temp. (° C.) | <342 | 343-383 | 384-404 | 405-440 | 441-497 |
| °API | 55 | 39 | 35 | 31 | 29 |
| Density (g/cm$^3$) | 0.76 | 0.83 | 0.85 | 0.87 | 0.88 |
| Viscosity @ 50° C. (cP) | 4.62 | nd | nd | 14.67 | nd |
| Aniline Point (° C.) | 60 | 64 | 62 | 59 | 58 |
| Flash Point (° C.) | 32 | 52 | 88 | 49 | 54 |
| Initial Boiling Point (° C.) | 125 | 220 | 240 | 125 | 130 |

nd = not determined

TABLE 8

80% MAYA:20% LIP DISTILLATES CHARACTERIZATION

| PROPERTY | F-1 | F-2 | F-3 | F-4 | F-5 |
|---|---|---|---|---|---|
| Recovery, Weight % | 19.1 | 9.4 | 14.5 | 20.5 | 14.6 |
| Distillation Temp. (° C.) | <320 | 320-340 | 340-417 | 418-452 | 453-475 |
| °API | 62 | 45 | 35 | 33 | 31 |
| Density (g/cm$^3$) | 0.73 | 0.8 | 0.85 | 0.86 | 0.87 |
| Viscosity @ 50° C. (cP) | 5.13 | nd | nd | 8.22 | nd |
| Aniline Point (° C.) | 54 | 60 | 60 | 59 | 52 |
| Flash Point (° C.) | 32 | 76 | 45 | 65 | 36 |
| Initial Boiling Point (° C.) | 90 | 160 | 125 | 190 | 150 |

nd = not determined

The properties of the vacuum residuum from the distillation of the Maya crude by itself, the LIP by itself, and the 80:20 and 70:30 blends are listed in Table 9 below. These data show that the resid is unexpectedly improved relative to that from the crude by itself such that a delayed coker is not needed or is only needed for a much lesser volume of coke product. For example, the low CCR values and low flow temperatures of the resid from the blends indicates that the resid can be used as a lube stock, which is a very valuable product compared to resid from distillation of the crude by itself. Moreover, if the resid is processed in a delayed coker, the products from the delayed coker are of much higher quality.

TABLE 9

CHARACTERISTICS OF RESID FROM CRUDE, LIP, AND BLENDS

| Resid Product From | CCR, wt % | Flow T, ° C. |
|---|---|---|
| 100% Maya Crude | 30 | >400 |
| 20% LIP/80% Crude | 18 | 50 |
| 30% LIP/70% Crude | 10 | 40 |
| 100% LIP | 1 | <0 |

Example 8: Diesel Upgrading

Diesel fuel was obtained commercially and blended with an LIP obtained by FCIP of the diesel fuel at a weight ratio of 80:20 diesel:LIP. The blend and the diesel were distilled from 58° C. to 220° C. similarly to the method of Example 5. The product yields are given in Table 10 below. The distillate yields for the fractions 1: 58-100° C., 2: 100-180° C., 3: 180-220° C., and residual (>220° C.) are given in Table 11 below. The aniline points, corresponding to aromatics contents, are presented in Table 12.

TABLE 10

DIESEL AND LIP BLEND DISTILLATION

| Product | Initial Boiling Point, ° C. | Distillate (<220° C.), wt % | Resid (>220° C.), wt % | Gas, wt % | Resid CCR, wt % |
|---|---|---|---|---|---|
| Diesel | 58 | 54 | 44 | 2 | 0 |
| 80:20 blend* | 60 | 83 | 16 | 1 | 0 |

Note:
*= 80 wt % diesel fuel, 20 wt % LIP from FCIP of diesel fuel

TABLE 11

DIESEL AND BLEND DISTILLATION PRODUCT PROPORTIONS

| Product | 58-100° C., wt % | 100-180° C., wt % | 180-220° C., wt % |
|---|---|---|---|
| Diesel | 9 | 49 | 42 |
| 80:20 blend* | 20 | 41 | 39 |

Note:
*= 80 wt % diesel fuel, 20 wt % LIP from FCIP of diesel fuel

TABLE 12

DIESEL/BLEND DISTILLATION PRODUCT ANILINE POINTS

| Product | Starting Material | 1$^{st}$ Fraction 58-100° C. | 2$^{nd}$ Fraction 100-180° C. | 3$^{rd}$ Fraction 180-220° C. | Residual >220° C. |
|---|---|---|---|---|---|
| Diesel | 68 | 56 | 66 | 66 | 76 |
| 80:20 blend* | 66 | 40 | 64 | 64 | 86 |

Note:
*= 80 wt % diesel fuel, 20 wt % LIP from FCIP of diesel fuel

These data show that diesel can be upgraded to lower boiling products in high yield by FCIP and distillation of the LIP blend, with unexpected improvements in yield and properties. Notably, the residual material boiling above the 220° C. cut point from the mix had aniline point of 86 a pour point of −5° C. and a viscosity index of 253, compared to a pour point of −4° C. and a viscosity index of 303 for the residual (>220° C.) of the residual fraction from distillation of the diesel fuel by itself. These data indicate the distillates and resid materials from the diesel-LIP mixtures have excellent properties for a solvent, e.g., for use in an oil-based drilling fluid, or as base stock oils.

TABLE 13

CHROMATOGRAM COMPARISON OF FIRST FRACTION (<100° C.)

| Retention time (min) | Alkane | Relative response area (x10$^{-7}$) 1st Diesel Fraction | 1st LIP-Diesel Mix Fraction | % Increase or decrease |
|---|---|---|---|---|
| 12.9 | n-C10 | 3.320 | 5.04 | 51.81 |
| 14.4 | n-C11 | 5.036 | 5.99 | 18.86 |
| 15.6 | n-C12 | 1.532 | 2.507 | 63.64 |
| 16.7 | n-C13 | 1.210 | 2.248 | 85.79 |
| 17.8 | n-C14 | 0.5030 | 1.412 | 180.72 |
| 18.8 | n-C15 | 0.3740 | 7.758 | 107.43 |
| 20.1 | n-C16 | 0.4754 | 0.4304 | −9.47 |
| 25.3 | n-C17 | 0.3850 | 0.2760 | −28.31 |

Moreover, chromatographic analysis shows further unexpected results comparing the distillate fractions and the original diesel and diesel/LIP blend. The samples were analyzed by GC-MS of a 2 μL sample at a concentration of 2 volume percent in methylene chloride through an HP-5MS SEMIVOL column of 30 m length and 0.25 mm ID with a temperature ramp from 50° C. initially held for 6 minutes up to 315° C. at 15° C./minute. The original diesel and the original blend showed no significant difference and the chromatograms were virtually identical. Chromatograms of the first distillate fractions (<100° C.) showed higher response areas for the lower n-alkanes $C_{10-15}$ and lower response areas for the higher n-alkanes $C_{16-17}$ from the blend relative to the first fraction from the diesel itself. These results are shown in Table 13.

Chromatograms of the second distillate fractions (100-180° C.) showed higher response areas for the lower n-alkanes $C_{10-13}$ and lower response areas for the higher n-alkanes $C_{14-17}$ from the blend relative to the second fraction from the diesel itself. These results are shown in Table 14.

TABLE 14

CHROMATOGRAM COMPARISON OF SECOND FRACTION (<100° C.)

| | | Relative response area ($\times 10^{-7}$) | | |
|---|---|---|---|---|
| Retention time (min) | Alkane | 2nd Diesel Fraction | 2nd LIP-Diesel Mix Fraction | % Increase or decrease |
| 12.9 | n-C10 | 0.0789 | 2.27 | 2778.40 |
| 14.4 | n-C11 | 0.0517 | 5.49 | 963.70 |
| 15.6 | n-C12 | 0.340 | 2.69 | 693.23 |
| 16.7 | n-C13 | 0.408 | 3.68 | 803.31 |
| 17.8 | n-C14 | 0.558 | 0.404 | −27.62 |
| 18.8 | n-C15 | 0.535 | 0.322 | −39.80 |
| 20.1 | n-C16 | 0.510 | 0.210 | −58.86 |
| 25.3 | n-C17 | 0.491 | 0.163 | −66.91 |

Chromatograms of the third distillate fractions (180-220° C.) showed higher response areas for the lower n-alkanes $C_{10-12}$ and n-alkanes $C_{14-17}$, and a lower response area for the middle-range n-alkane $C_{13}$, from the blend, relative to the third fraction from the diesel itself. These results are shown in Table 15.

TABLE 15

CHROMATOGRAM COMPARISON OF THIRD FRACTION (<100° C.)

| | | Relative response area ($\times 10^{-7}$) | | |
|---|---|---|---|---|
| Retention time (min) | Alkane | 3rd Diesel Fraction | 3rd LIP-Diesel Mix Fraction | % Increase or decrease |
| 12.9 | n-C10 | 0.0650 | 0.623 | 858.89 |
| 14.4 | n-C11 | 0.449 | 2.75 | 512.73 |
| 15.6 | n-C12 | 2.70 | 3.05 | 13.05 |
| 16.7 | n-C13 | 4.42 | 3.58 | −19.05 |
| 17.8 | n-C14 | 4.55 | 7.12 | 56.56 |
| 18.8 | n-C15 | 4.25 | 5.19 | 22.21 |
| 20.1 | n-C16 | 4.84 | 5.02 | 3.66 |
| 25.3 | n-C17 | 4.67 | 6.37 | 36.33 |

Figure 10:
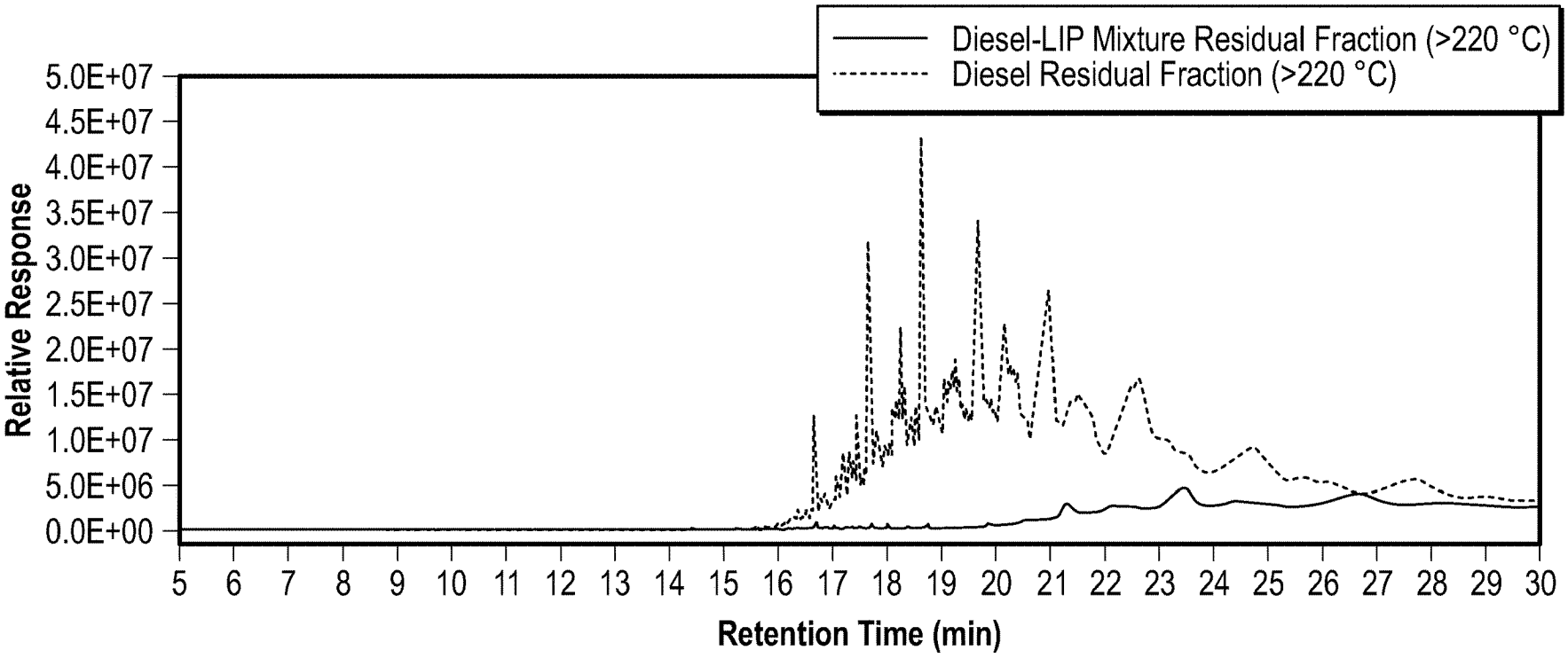
FIG. 10 shows chromatograms of the non-distilled, residual fraction (>220° C.) from the LIP-diesel blend of Example 6 according to an embodiment of the present invention, compared to the residual fraction from the diesel alone.

Chromatograms of the non-distilled, residual fractions (>220° C.) showed the residual from the diesel itself was composed of primarily $C_{12-17}$ hydrocarbons, whereas the residual from the blend was comprised of virtually no $C_{12-16}$ alkanes and consisted almost entirely of $C_{17+}$ hydrocarbons. See the chromatograms shown in FIG. 10.

Example 9: FCIP with Texistepec/Crude Oil-LIP Blends

In this example, flash chemical ionizing pyrolysis (FCIP) was conducted by the following procedure. The finely divided solids were the $FeCl_3$ on NaCl-treated bentonite prepared in a manner similar to Example 1A and/or 1B. The emulsion was prepared with a commercial blender, placed in a tank heated at 70-90° C., pressurized at 2-8 kg/cm$^2$ with inert gas, and fed to a nozzle with a conical spray pattern in a reactor measuring 8 in. diameter by 16 in. long. The reactor was heated using a gas burner, and a sand bed was placed in the reactor at the beginning of the test. The effluent was passed through a water-cooled condenser and the condensate was collected and separated into oil, water, and solids.

An 8° API Texistepec crude oil having a viscosity of 144,400 cP at 40° C. was used. The crude had a composition by retort distillation of 46.1 wt % oil (0-600° C.), 40.4 wt % heavy hydrocarbons (>600 to 800° C.), 8.1 wt % water, and 5.4 wt % inorganic solids. First, in Run 9-1, a baseline emulsion was prepared using all crude for the oil (0-600° C.) and heavy HC components, 14 wt % total water, and no finely divided solids other than the solids present in the crude (5.4 wt %), and subjected to flash pyrolysis at 500-550° C. The product ("LIP-T3") yield was just 55.2 wt % oil (<600° C.), 8.4 wt % gas, and 36.4 wt % coke.

Then, in Run 9-2, an emulsion was prepared using all crude for the oil and heavy oil components, 16.2 wt % total water, and 3.8 wt % finely divided solids and subjected to FCIP at 500-550° C. The FCIP product mix obtained a gas yield of 1.3 wt %, an oil ("LIP-T4") yield of 87.7 wt %, and coke yield of 11 wt %, expressed as percentages of the oil in the FCIP emulsion.

Then, in Run 9-3, an emulsion was prepared using 90 wt % of the crude and 10 wt % of the LIP-T4 from Run 9-2, similarly subjected to FCIP at 500-550° C. The yields were gas 1.3 wt %, oil ("LIP-B5") 95.2 wt %, and coke 3.5 wt %, expressed as percentages of the oil in the FCIP emulsion. These represent unexpected yield increases in the oil LIP-B5 and decreases in the resid and coke, all to a greater extent than theoretical (assuming the added LIP-T4 gives 100% oil and 0% coke yield). The results are summarized in Table 16.

TABLE 16

TEXISTEPEC, BLENDS, AND FCIP CHARACTERIZATION

| Property | Unit | TXPC | Run 9-1 | Run 9-2 | Run 9-3 |
|---|---|---|---|---|---|
| FCIP EMULSION FEED COMPOSITION | | | | | |
| Oil (<600° C.) | wt % | 46.1 | 42.6 | 40.1 | 37.4 |
| Heavy HC | wt % | 40.4 | 37.3 | 35.2 | 32.7 |
| LIP-T1 | wt % | — | — | — | 10.0 |
| Water | wt % | 8.1 | 15.2 | 16.2 | 12.7 |
| Finely divided solids | wt % | — | — | 3.8 | 3.5 |
| Other solids | wt % | 5.4 | 4.9 | 4.7 | 3.7 |
| Reactor Temperature | ° C. | N/A | 500-550 | 500-550 | 500-550 |
| PRODUCT YIELDS | | | | | |
| Oil (<600° C.) | wt % | N/A | 55.2 | 87.7 | 95.2 |
| Gas | wt % | N/A | 8.4 | 1.3 | 1.3 |
| Coke | wt % | N/A | 36.4 | 11.0 | 3.5 |
| PRODUCT OIL (LIP) PHYSICAL PROPERTIES | | | | | |
| Oil Designation | | | LIP-T3 | LIP-T4 | LIP-B5 |
| °API | °API | 8 | 12 | 21 | 21 |
| Density | g/cm$^3$ | 1.16 | 0.96 | 0.93 | 0.93 |
| Viscosity @40° C. | cP | 144,400 | 55 | 52.2 | 44.0 |

TABLE 16-continued

TEXISTEPEC, BLENDS, AND FCIP CHARACTERIZATION

| Property | Unit | TXPC | Run 9-1 | Run 9-2 | Run 9-3 |
|---|---|---|---|---|---|
| Viscosity@100° C. | cP | 4,722 | 22.0 | 19.2 | 17.8 |
| Flash Point | ° C. | 204 | 78 | 75 | 85 |
| Initial Boiling Point | ° C. | 280 | 145 | 142 | 120 |
| Conradson carbon | % CC | 18.2 | 8.0 | 4.0 | 2.8 |

The invention has been described above with reference to numerous embodiments and specific examples. Many variations will suggest themselves to those skilled in this art in light of the above detailed description. All such obvious variations are within the full intended scope of the appended claims.

What is claimed is:

1. A hydrocarbon conversion process, comprising the steps of:

emulsifying water and an oil component with finely divided solids comprising a mineral support and an oxide and/or acid addition salt of a Group 3-16 metal;

introducing the emulsion into a flash chemical ionizing pyrolysis (FCIP) reactor maintained at a temperature greater than about 400° C. up to about 600° C. and a pressure up to about 1.5 atm to form a chemical ionizing pyrolyzate effluent;

condensing a liquid ionizing pyrolyzate (LIP) from the effluent;

combining a feedstock oil with the LIP to form a pyrolyzate-feedstock blend; and thermally processing the blend at a temperature above about 100° C.

2. The process of claim 1, wherein the solids comprise brine-treated clay and an acid addition salt of a Group 8-10 metal, wherein the brine comprises a salt that forms a eutectic with the acid addition salt of the Group 8-10 metal.

3. The process of claim 2, wherein the clay comprises bentonite, the brine comprises sodium chloride, and the acid addition salt comprises $FeCl_3$.

4. The process of claim 3, comprising preparing the solids by a method comprising the steps of:

(a) contacting bentonite with the sodium chloride brine;

(b) contacting an excess of iron with an aqueous mixture of hydrochloric and nitric acids to form $FeCl_3$ solids;

(c) loading the $FeCl_3$ solids on the brine-treated bentonite; and (d) calcining the loaded bentonite at a temperature below the FCIP temperature.

5. The process of claim 1, further comprising the steps of:

wherein the emulsion comprises (i) 100 parts by weight of the oil component; (ii) from about 1 to 100 parts by weight of water, and (iii) from about 1 to 20 parts by weight of the finely divided solids; and spraying the emulsion into the reactor, wherein the reactor temperature is from about 425° C. to about 600° C.

6. The process of claim 5 wherein the finely divided solids comprise the product of the method comprising the steps of:

treating iron with an aqueous mixture of hydrochloric and nitric acids to form a solids mixture of $FeCl_3$ optionally with mixed valences of iron and iron chlorides, nitrites, nitrites, oxides, and/or hydroxides, wherein the solids mixture has limited solubility;

treating montmorillonite with NaCl brine and drying the treated montmorillonite;

combining a slurry of the solids mixture with the treated montmorillonite to load the $FeCl_3$ on the montmorillonite; and heat treating the loaded montmorillonite at a temperature above 400° C.

7. The process of claim 5, wherein the oil component comprises the pyrolyzate-feedstock blend.

8. The process of claim 5 wherein the reactor temperature is from 450° C. to 500° C.

9. The process of claim 1, wherein the feedstock oil comprises hydrocarbons boiling at a temperature equal to or greater than 562° C., and further comprising the step of recovering a hydrocarbon product from the thermally processed blend, the hydrocarbon product having an enriched yield of liquid hydrocarbons boiling at a temperature below 562° C., relative to separate thermal processing of the LIP and feedstock oil, as determined by atmospheric distillation in a 15-theoretical plate column at a reflux ratio of 5:1, according to ASTM D2892-18 up to cutpoint 400° C. AET, and by vacuum potstill method according to ASTM D5236-18a above the 400° C. cutpoint to cutpoint 562° C. AET.

10. The process of claim 9 wherein the feedstock oil comprises crude oil, gas oil, resid, or a mixture thereof.

11. The process of claim 1 wherein the thermal processing comprises pyrolysis, distillation, cracking, alkylation, visbreaking, coking, and combinations thereof.

12. The process of claim 11 wherein the feedstock oil comprises crude oil and further comprising washing the LIP blend with wash water, recovering a solute-enriched spent water from the water washing step, recovering a desalted LIP blend, and heating the desalted LIP blend in advance of distillation of the LIP blend.

13. The process of claim 1, further comprising supplying at least a portion of the pyrolyzate-feedstock blend as the oil component to the FCIP feed emulsion preparation step wherein the thermal processing step consists of or comprises the spraying of the FCIP feed emulsion into the flash pyrolysis reactor.

14. A flash chemical ionizing pyrolysis (FCIP) process comprising the steps of:

preparing a feed emulsion comprising (i) 100 parts by weight of an oil component comprising a liquid ionizing pyrolyzate (LIP) blend component and a feedstock oil at a weight ratio of from 1:100 to 1:1, (ii) from about 1 to 100 parts by weight of water, and (iii) from about 1 to 20 parts by weight finely divided solids comprising a mineral support and an oxide or acid addition salt of a Group 3-16 metal;

spraying the feed emulsion in a flash pyrolysis reactor at a temperature from about 425° C. to about 600° C.;

collecting an effluent from the reactor;

recovering a product LIP from the effluent; and supplying a portion of the product LIP as the LIP blend component to the feed emulsion preparation step.

15. A hydrocarbon refinery process comprising the steps of:

combining a liquid ionizing pyrolyzate (LIP) blend component with a feedstock oil at a weight ratio from about 1:100 to about 1:1 to form an LIP blend;

preparing an emulsion comprising (i) a first portion of the LIP blend, (ii) water, and (iii) from finely divided solids comprising a mineral support and an oxide or acid addition salt of a Group 3-16 metal;

spraying the emulsion in a flash pyrolysis reactor at a temperature from about 425° C. to about 600° C. and a pressure from about 1 to about 1.5 atm;

collecting an effluent from the reactor;

recovering a product LIP from the effluent;

incorporating the product LIP as the LIP blend component in the LIP blend; and distilling a second portion of the LIP blend.

16. The process of claim 15, wherein the feedstock oil comprises crude oil.

17. The process of claim 16, wherein the feedstock oil comprises un-desalted crude oil wherein the process further comprises water washing to desalt the second portion of the LIP blend, and distilling the desalted second portion of the LIP blend.

18. A hydrocarbon refinery process comprising the steps of:

preparing a feed emulsion comprising (i) 100 parts by weight of an oil component, (ii) from about 1 to 100 parts by weight of water, and (iii) from about 1 to 20 parts by weight finely divided solids comprising a mineral support and an oxide or acid addition salt of a Group 3-16 metal;

spraying the feed emulsion in a flash pyrolysis reactor at a temperature from about 425° C. to about 600° C.;

collecting an effluent from the flash pyrolysis reactor;

recovering a liquid ionizing pyrolyzate (LIP) from the effluent;

combining the recovered LIP with a feedstock oil comprising crude oil or a petroleum fraction selected from gas oil, resid, or a combination thereof to form a pyrolyzate-feedstock blend;

distilling, cracking, visbreaking, and/or coking a first portion of the blend; and supplying a second portion of the blend as the oil component in the feed emulsion preparation step.

19. The process of claim 18, wherein the LIP exhibits a SARA analysis having higher saturates and aromatics contents and a lower asphaltenes content than the feedstock oil.

20. The process of claim 18 wherein a proportion of the LIP in the oil component in the flash pyrolysis is effective to improve yield of liquid hydrocarbons boiling at a temperature below 562° C., relative to separate flash chemical ionizing pyrolysis of the LIP and feedstock oil, as determined by atmospheric distillation in a 15-theoretical plate column at a reflux ratio of 5:1, according to ASTM D2892-18 up to cutpoint 400° C. AET, and by vacuum potstill method according to ASTM D5236-18a above the 400° C. cutpoint to cutpoint 562° C. AET.

21. The process of claim 18 wherein a proportion of the LIP in the LIP blend in the distillation, cracking, visbreaking, and/or coking step, is effective to improve yield of liquid hydrocarbons boiling at a temperature below 562° C., relative to separate distillation, cracking, visbreaking, and/or coking of the LIP and feedstock oil, as determined by atmospheric distillation in a 15-theoretical plate column at a reflux ratio of 5:1, according to ASTM D2892-18 up to cutpoint 400° C. AET, and by vacuum potstill method according to ASTM D5236-18a above the 400° C. cutpoint to cutpoint 562° C. AET.

22. A crude oil upgrading process, comprising:

flash chemical ionizing pyrolysis of an emulsion of oil, water, mineral support, and an oxide and/or acid addition salt of a Group 3-16 metal, to obtain a liquid ionizing pyrolyzate (LIP);

blending the LIP with a heavy oil; and thermally processing the blend at a temperature above about 100° C.

* * * * *